US012320574B2

(12) United States Patent
Seo et al.

(10) Patent No.: US 12,320,574 B2
(45) Date of Patent: Jun. 3, 2025

(54) REFRIGERATOR

(71) Applicant: LG Electronics Inc., Seoul (KR)

(72) Inventors: Haewon Seo, Seoul (KR); Dohyun Park, Seoul (KR); Sunghee Kang, Seoul (KR); Kihwang Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 315 days.

(21) Appl. No.: 17/790,591

(22) PCT Filed: Nov. 11, 2021

(86) PCT No.: PCT/KR2021/016453
§ 371 (c)(1),
(2) Date: Jul. 1, 2022

(87) PCT Pub. No.: WO2022/163979
PCT Pub. Date: Aug. 4, 2022

(65) Prior Publication Data

US 2023/0122785 A1 Apr. 20, 2023

(30) Foreign Application Priority Data

Jan. 26, 2021 (KR) ..... 10-2021-0010777

(51) Int. Cl.
*F25D 17/06* (2006.01)

(52) U.S. Cl.
CPC ..... *F25D 17/062* (2013.01)

(58) Field of Classification Search
CPC ..... F25D 17/062; F25D 2317/0682; F25D 2317/0683; F25D 17/067; F25D 11/00;
(Continued)

(56) References Cited

U.S. PATENT DOCUMENTS 2,241,023 A * 5/1941 Tanner ..... F25D 19/02 62/450
2,275,323 A * 3/1942 Schweller ..... F25D 17/062 62/418

(Continued)

FOREIGN PATENT DOCUMENTS

CN 107388699 11/2017
CN 211625825 U 10/2020

(Continued)

OTHER PUBLICATIONS

KR 20190121437 A (Year: 2024).*

(Continued)

*Primary Examiner* — Eric S Ruppert
*Assistant Examiner* — Kirstin U Oswald
(74) *Attorney, Agent, or Firm* — Bryan Cave Leighton Paisner LLP

(57) ABSTRACT

A refrigerator includes a cabinet, a first storage chamber and a second storage chamber, and a grille fan assembly partitioning the first storage chamber into a space receiving an evaporator, and a grille fan assembly including a grille panel, a shroud supporting a first fan and a second fan, a heat insulating member provided between the grille panel and the shroud and defining a first flow path configured to supply cold air blown by the first fan to the first storage chamber and a second flow path configured to supply cold air blown by the second fan to the second storage chamber, and a duct connector provided at a position corresponding to the second fan between the shroud and the heat insulating member and connected to the second flow path part to define an independent flow path.

19 Claims, 12 Drawing Sheets

(58) Field of Classification Search
CPC ..... F25D 17/08; F25D 21/14; F25D 23/006; F25D 23/065; F25D 2317/0664; F25D 17/065; F25D 2317/067; F25D 2321/142
USPC ..... 62/419
See application file for complete search history.

(56) References Cited

U.S. PATENT DOCUMENTS

| | | | | | |
|---|---|---|---|---|---|
| 3,004,401 | A * | 10/1961 | Mann | F25D 17/065 | 62/275 |
| 3,252,292 | A * | 5/1966 | John | F25D 17/065 | 62/298 |
| 3,321,933 | A * | 5/1967 | Scheitlin | F25D 17/065 | 62/414 |
| 3,394,557 | A * | 7/1968 | Kronenberger | F25D 17/065 | 62/186 |
| 3,455,119 | A * | 7/1969 | Bright | F25D 17/065 | 62/405 |
| 3,590,594 | A * | 7/1971 | Arend | F25D 17/065 | 62/97 |
| 4,075,866 | A * | 2/1978 | Williamitis | F25D 17/042 | 62/274 |
| 5,081,850 | A * | 1/1992 | Wakatsuki | F25D 17/08 | 62/405 |
| 5,433,086 | A * | 7/1995 | Cho | F25D 17/065 | 62/275 |
| 5,784,895 | A * | 7/1998 | Choi | F25D 23/023 | 62/256 |
| 5,819,552 | A * | 10/1998 | Lee | F25D 17/065 | 62/407 |
| 5,911,750 | A * | 6/1999 | Mandel | F25D 17/065 | 62/89 |
| 6,318,099 | B1 * | 11/2001 | Hwang | F25D 17/065 | 62/187 |
| 6,370,882 | B1 * | 4/2002 | Adamski | F25D 19/00 | 62/3.6 |
| 6,381,982 | B1 * | 5/2002 | Kim | F25D 17/065 | 62/411 |
| 8,196,427 | B2 * | 6/2012 | Bae | F25D 17/065 | 62/411 |
| 9,964,349 | B2 | 5/2018 | Cho et al. | | |
| 10,527,338 | B2 * | 1/2020 | Kim | F25D 17/065 | |
| 2008/0202149 | A1 * | 8/2008 | Lim | F25D 17/067 | 62/407 |
| 2016/0273823 | A1 | 9/2016 | Cho et al. | | |
| 2017/0343269 | A1 * | 11/2017 | Kim | F25D 23/068 | |
| 2018/0087814 | A1 * | 3/2018 | Han | F25D 17/065 | |
| 2018/0224185 | A1 * | 8/2018 | Besore | F25D 17/045 | |
| 2020/0103158 | A1 | 4/2020 | Kim et al. | | |

FOREIGN PATENT DOCUMENTS

| | | | |
|---|---|---|---|
| CN | 111879048 | | 11/2020 |
| JP | 2008121939 | | 5/2008 |
| KR | 20100076089 | | 7/2010 |
| KR | 10-2011-0097014 | A | 8/2011 |
| KR | 101659622 | | 9/2016 |
| KR | 1020160112878 | A | 9/2016 |
| KR | 20170133840 | | 12/2017 |
| KR | 1020180124451 | A | 11/2018 |
| KR | 20190121437 | A * | 10/2019 |
| KR | 10-2021-0072576 | A | 6/2021 |

OTHER PUBLICATIONS

International Search Report in International Appln. No. PCT/KR2021/016453, dated Apr. 28, 2022, 4 pages.
Office Action in Korean Appln. No. 10-2021-0010777, dated May 19, 2022, 5 pages.

* cited by examiner

[Fig. 1]
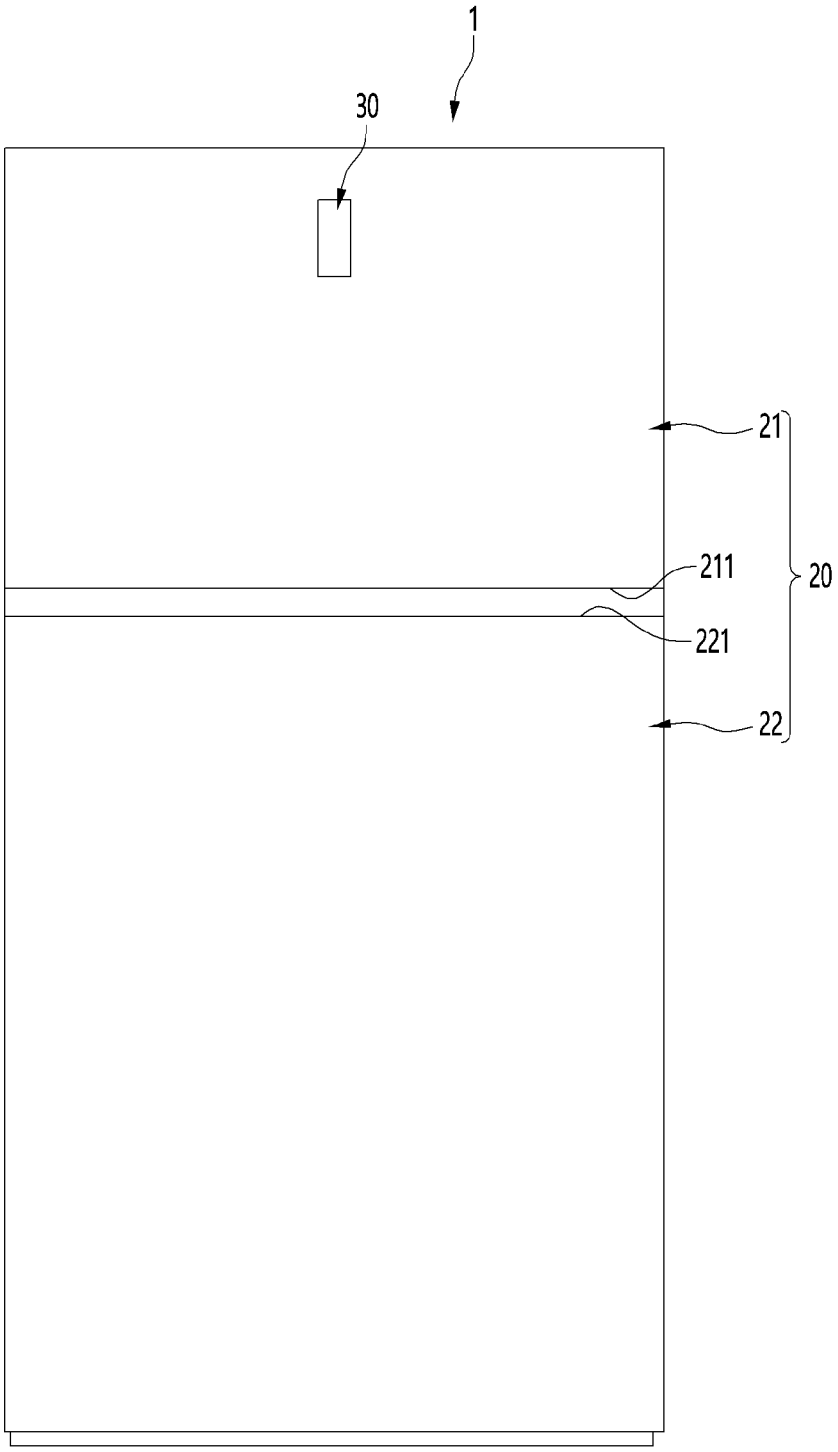

[Fig. 2]
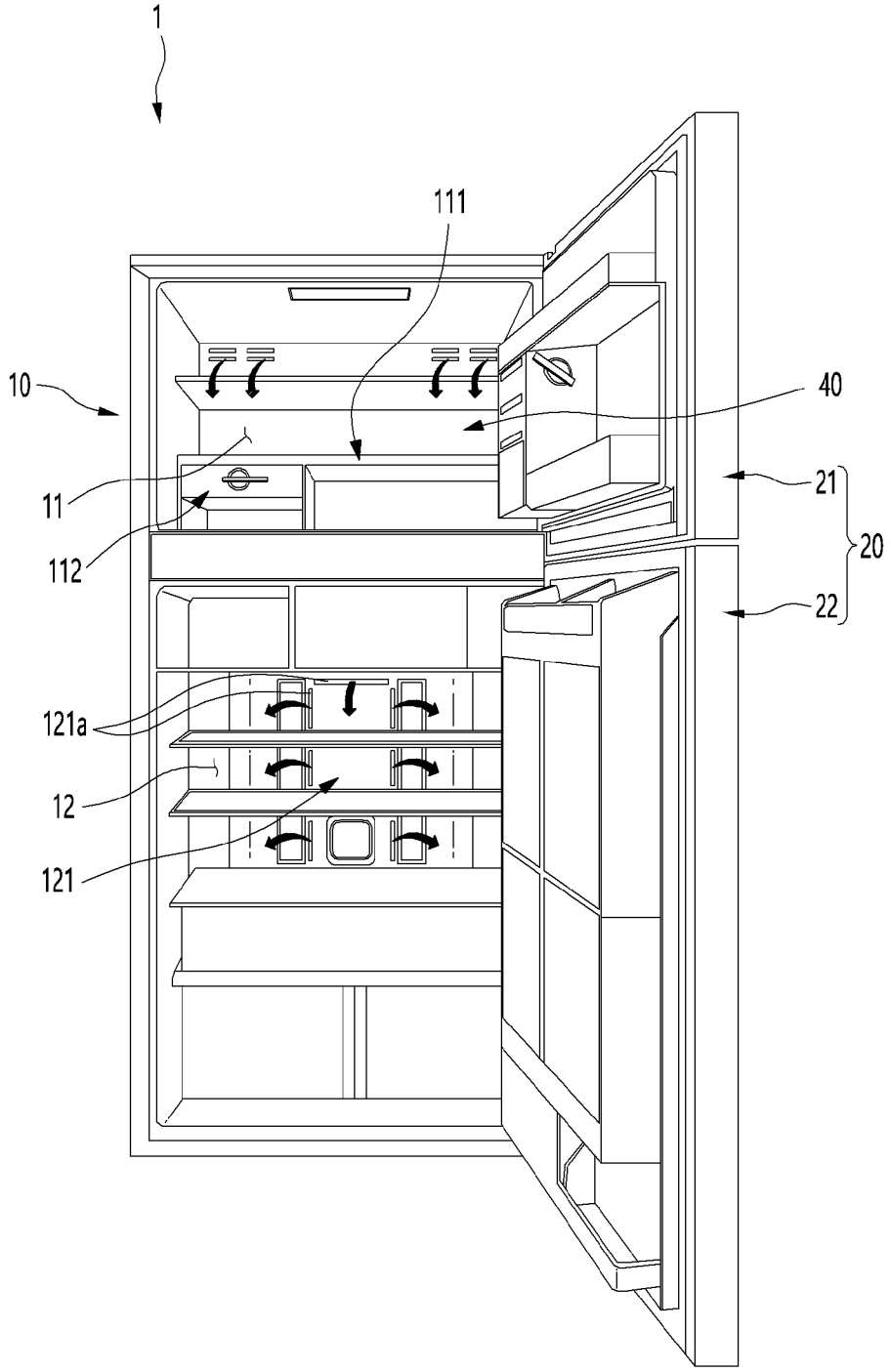

[Fig. 3]
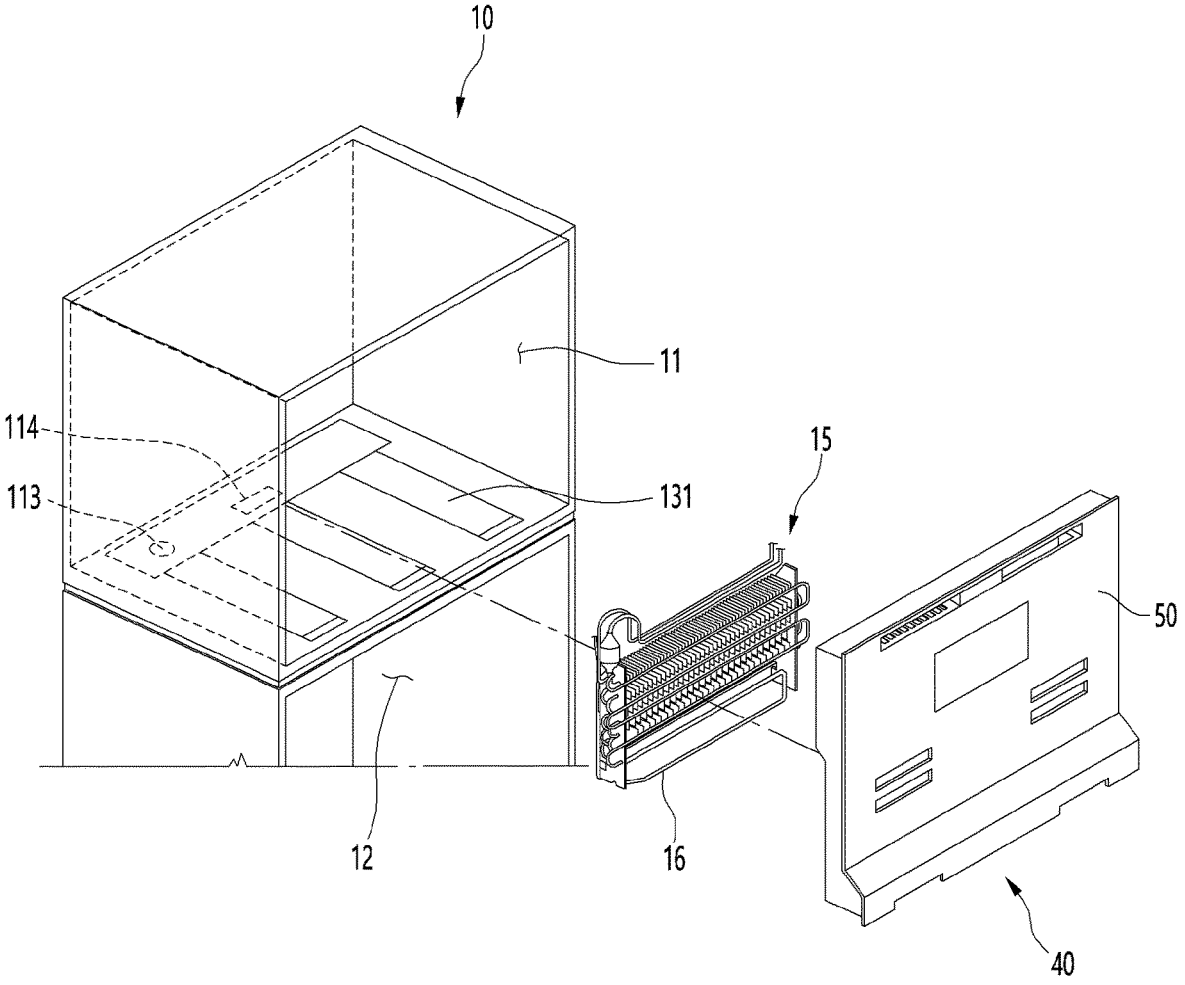

[Fig. 4]
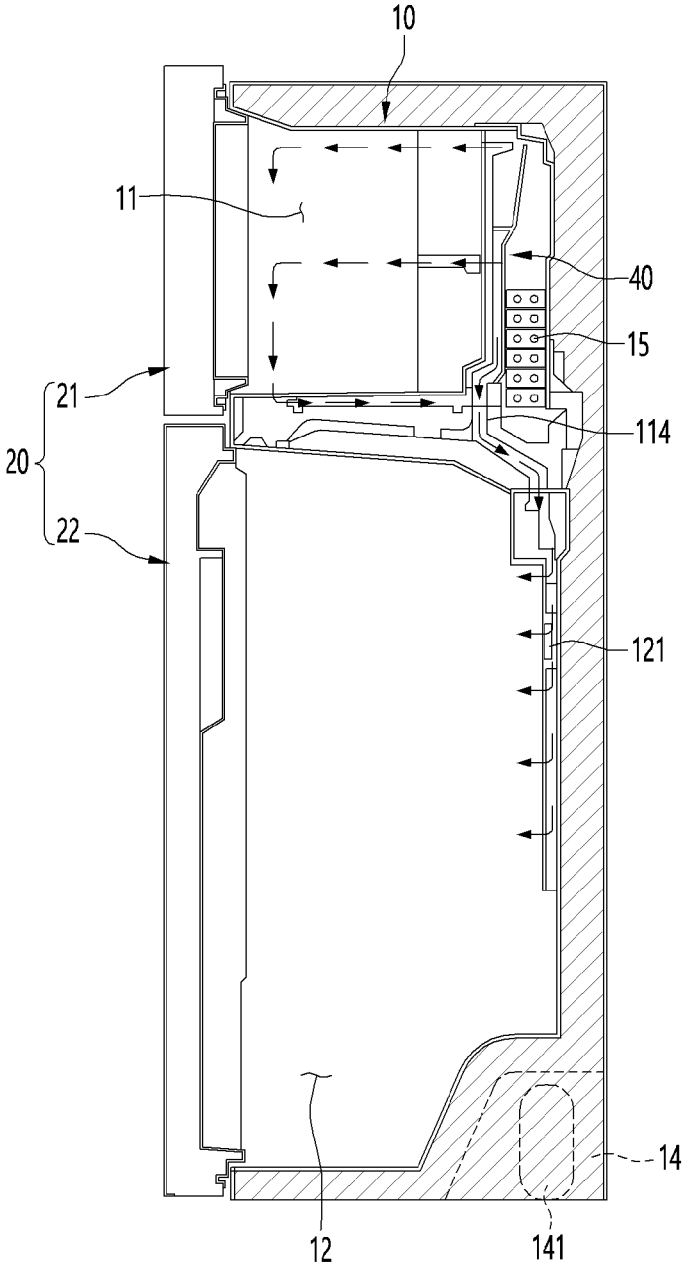

[Fig. 5]
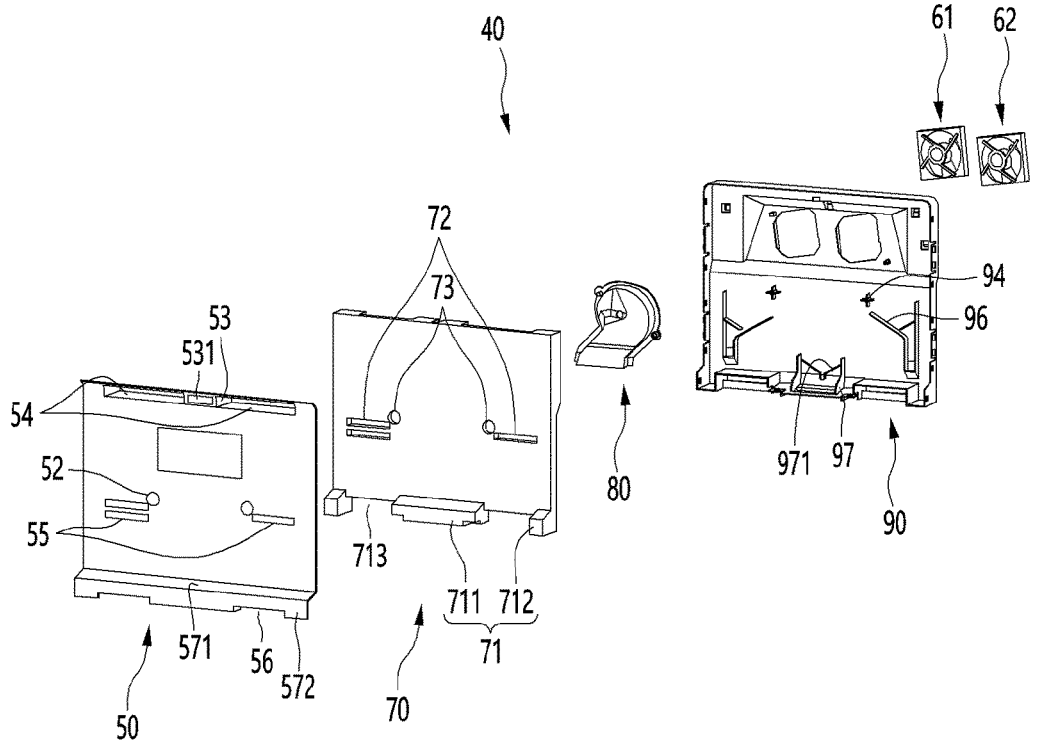
[Fig. 6]
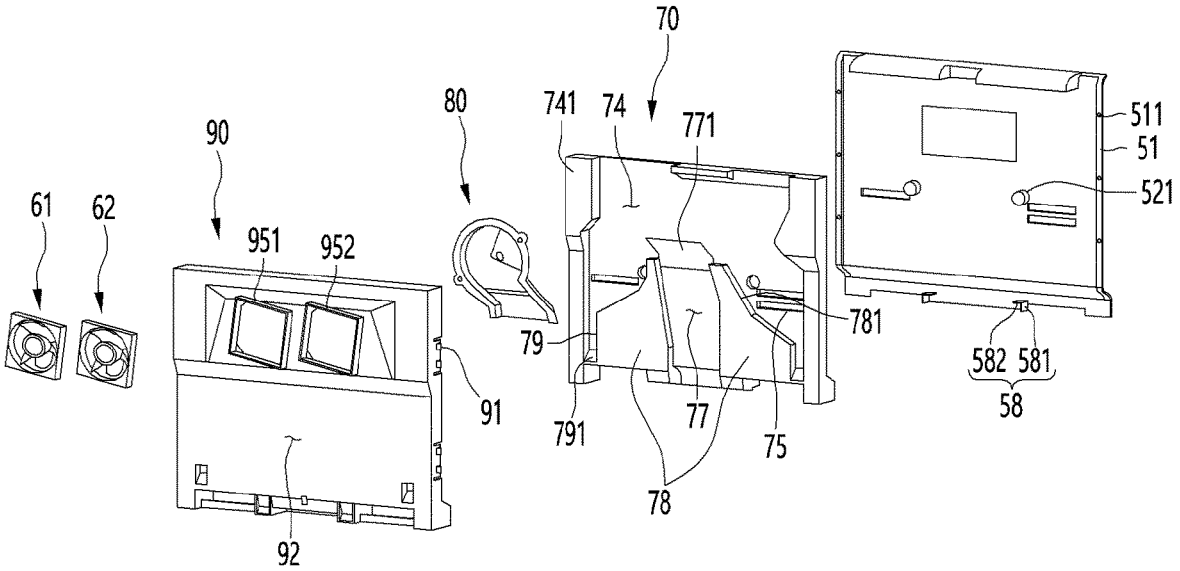

[Fig. 7]
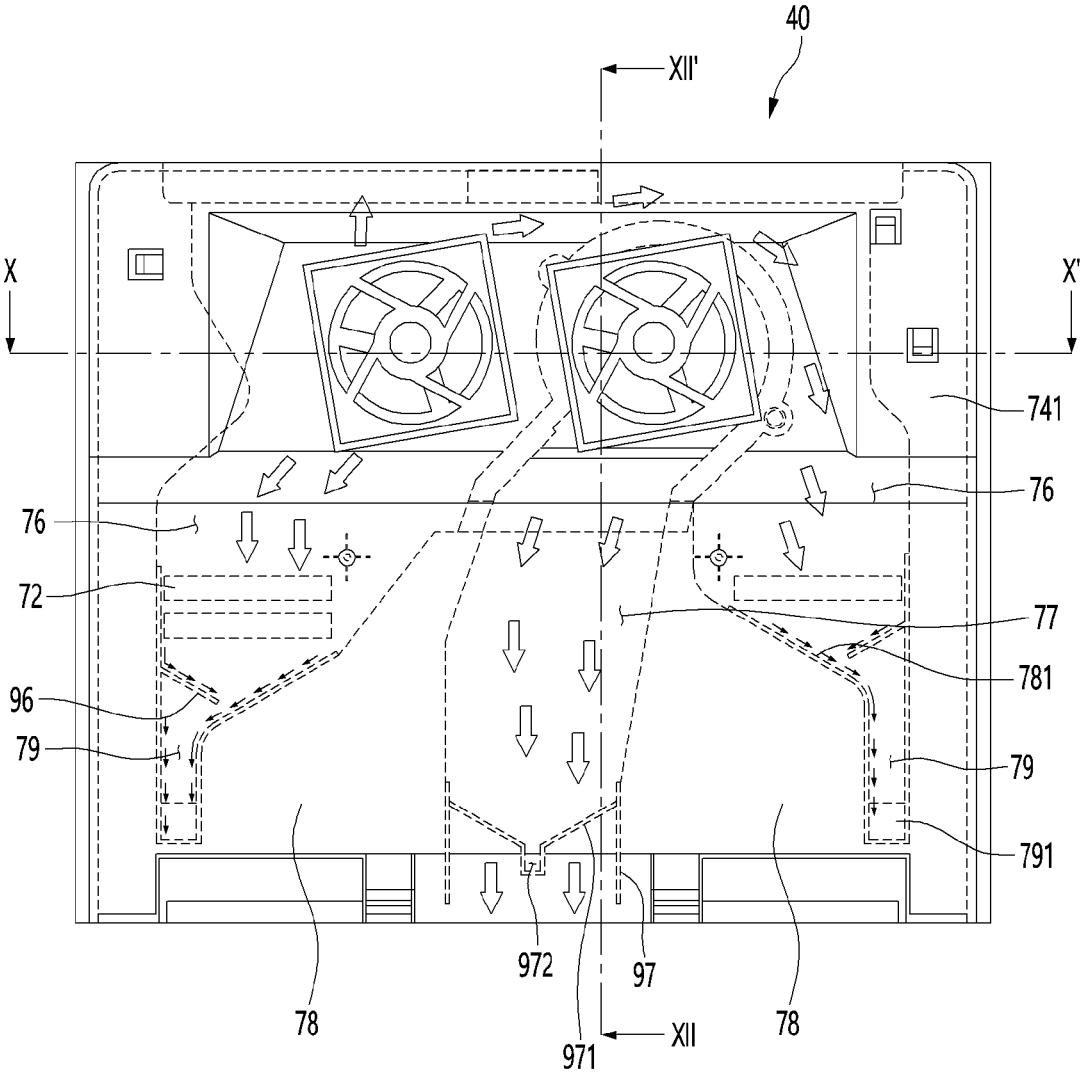

[Fig. 8]
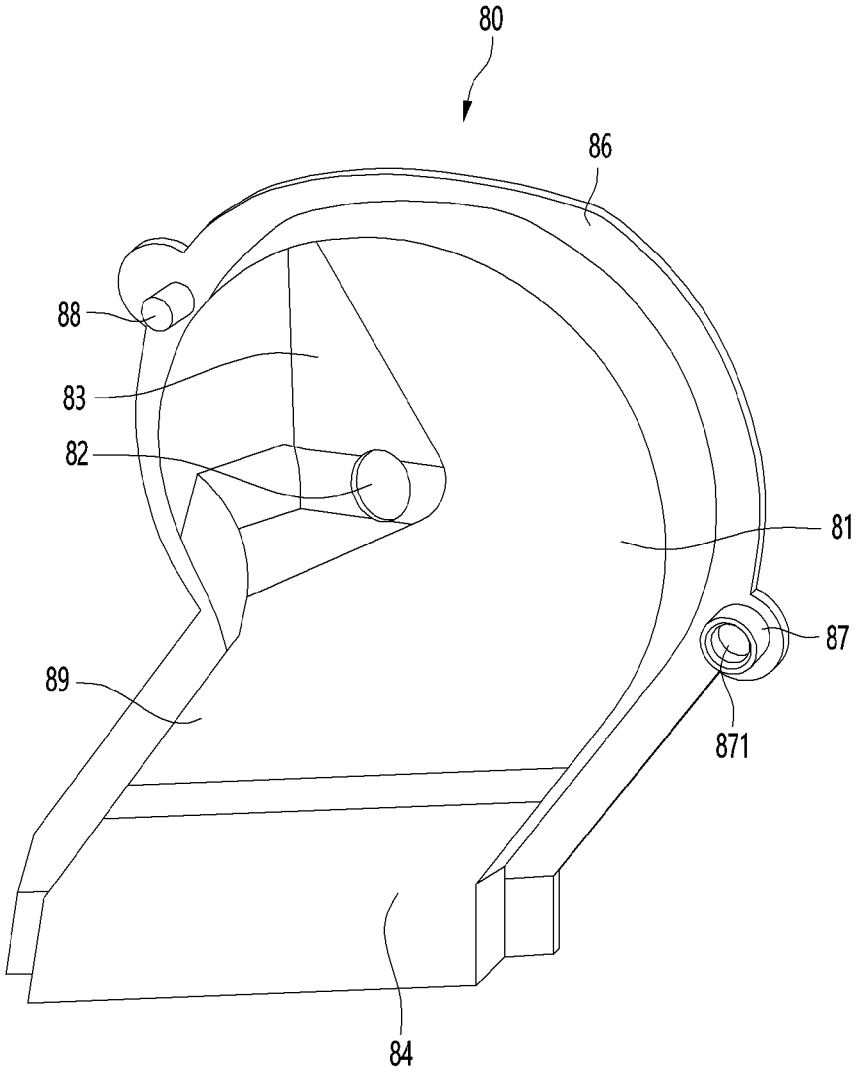

[Fig. 9]
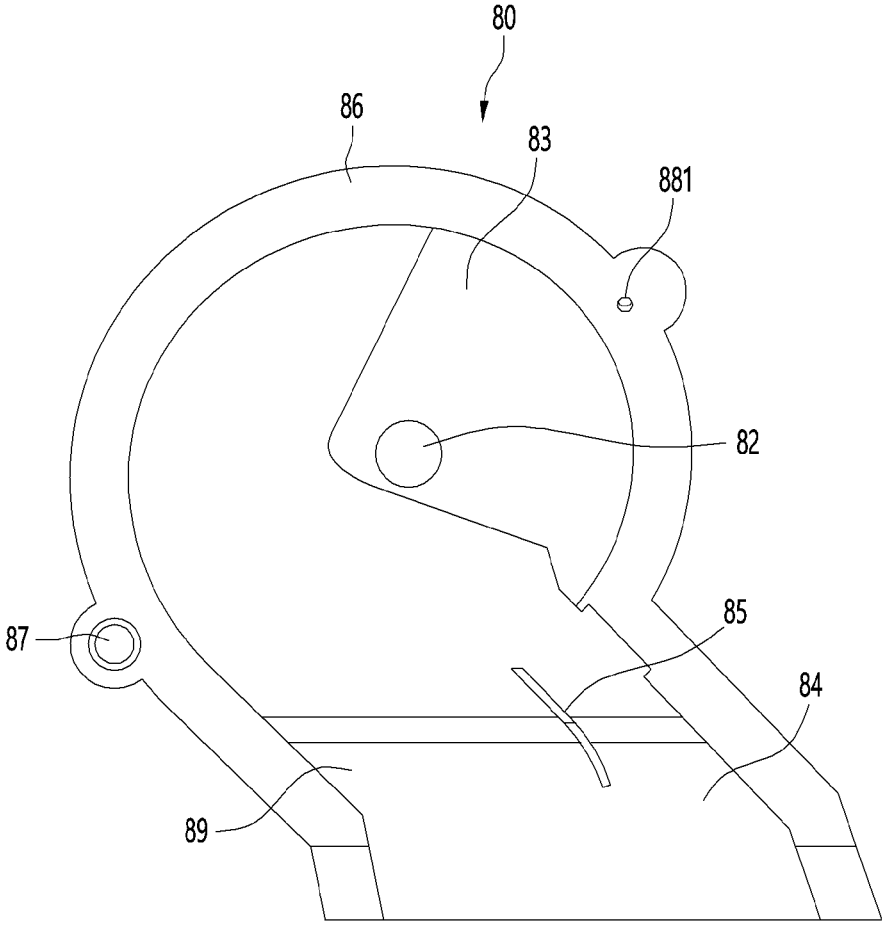
[Fig. 10]
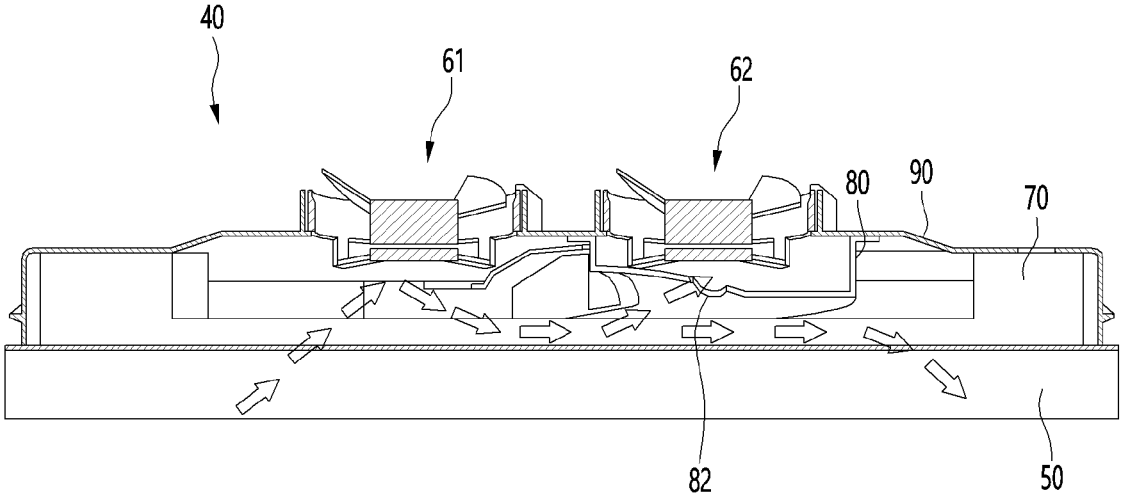

[Fig. 11]
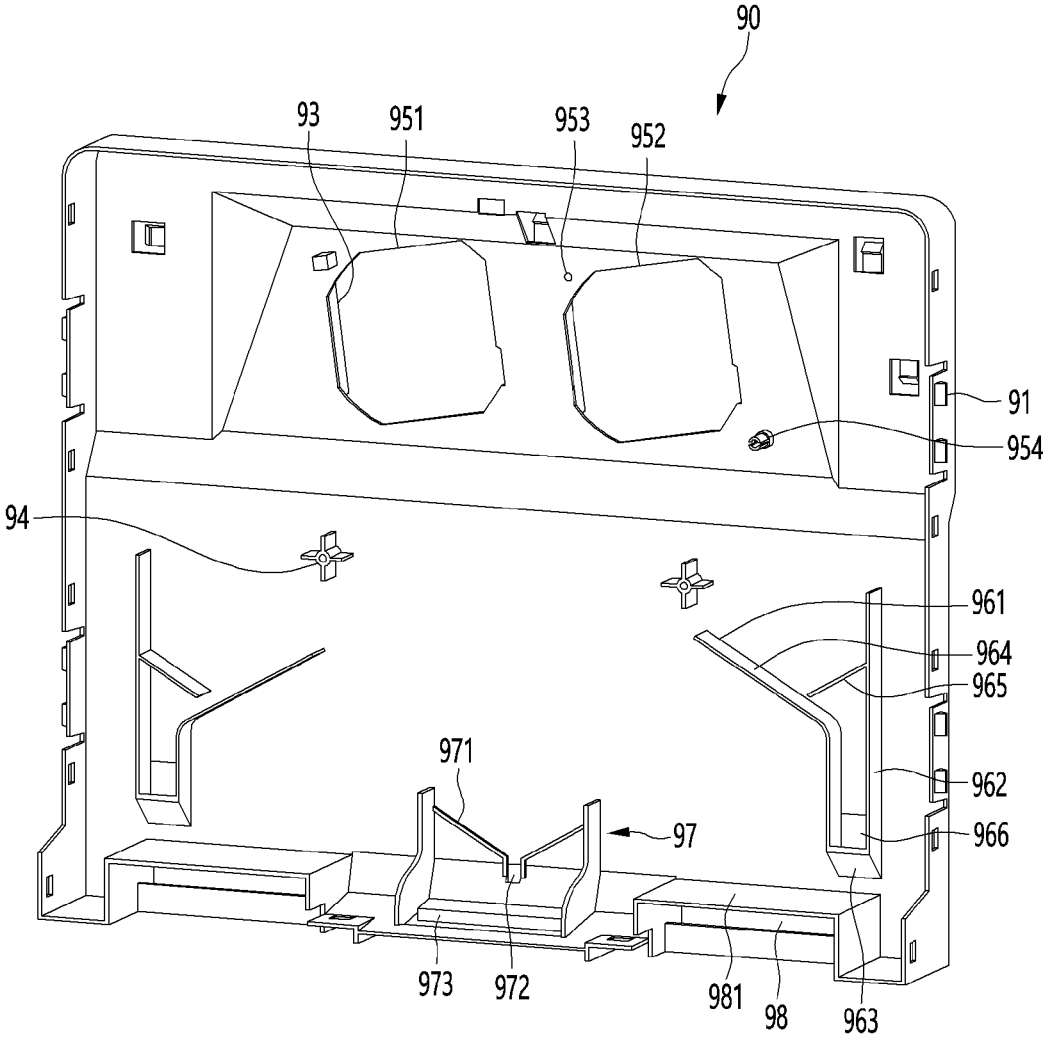

[Fig. 12]
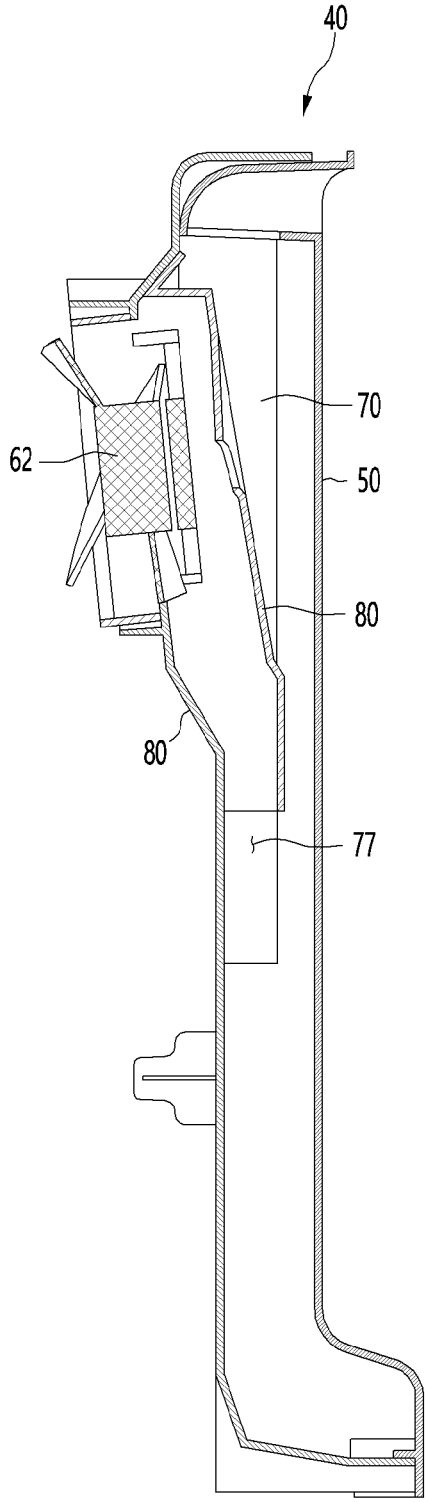

[Fig. 13]
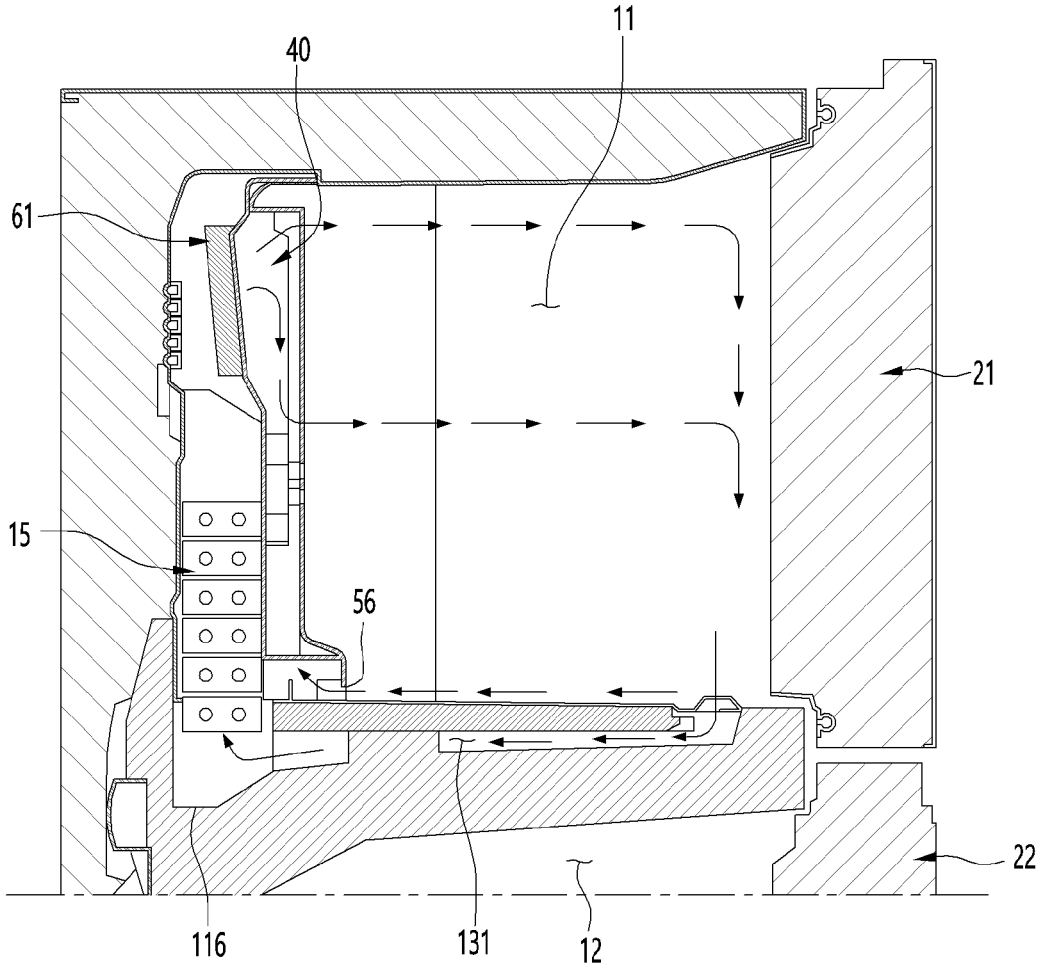

[Fig. 14]
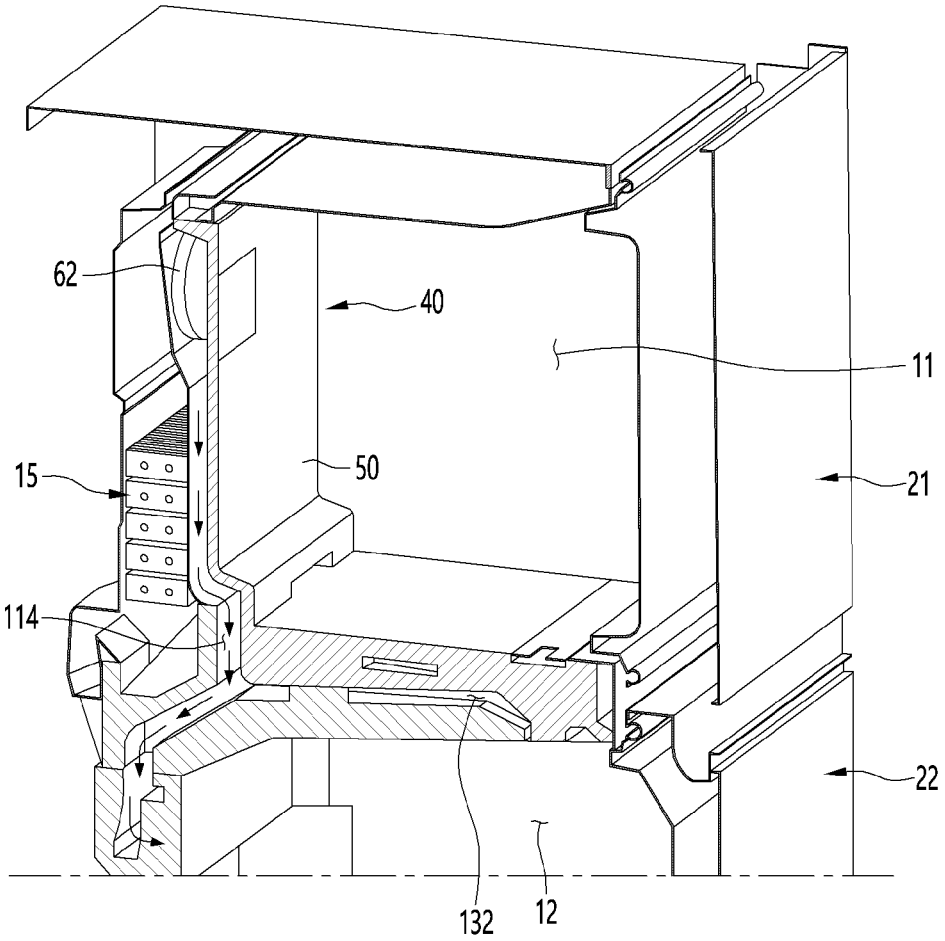

REFRIGERATOR

CROSS-REFERENCE TO RELATED APPLICATIONS

This application is a National Stage application under 35 U.S.C. § 371 of International Application No. PCT/KR2021/016453, filed on Nov. 11, 2021, which claims the benefit of Korean Patent Application No. 10-2021-0010777, filed on Jan. 26, 2021. The disclosures of the prior applications are incorporated by reference in their entirety.

TECHNICAL FIELD

The present disclosure relates to a refrigerator.

BACKGROUND ART

In general, a refrigerator is a home appliance that can store food at a low temperature in an internal storage space that is shielded by a door. To this end, the refrigerator is configured to store the stored food in an optimal state by cooling the inside of the storage space using cold air generated through heat exchange with the refrigerant circulating in the refrigeration cycle.

Such a refrigerator is capable of maintaining a set temperature in the refrigerator so that the food stored therein can always be stored in the best state due to the characteristics of use. In addition, in order to maintain the set temperature, the inside of the refrigerator has to be sealed, and the refrigerator is configured to have a structure in which continuous cooling is possible through the supply of cold air using a refrigeration cycle.

In Korean Patent Laid-Open No. 10-2010-0076089, a top-mount type refrigerator in which a freezing chamber is provided on an upper side thereof and an evaporator is provided on the freezing chamber is disclosed. In addition, a refrigerator in which the cold air generated by the evaporator is configured to be supplied to the refrigerating chamber and the freezing chamber by a blower fan and a damper, and in particular, in which a heat generating member is provided in the space of the freezing chamber and the inside of which can be used as a switching chamber is disclosed.

DISCLOSURE

Technical Problem

An object of the present disclosure is to provide a refrigerator capable of cooling two separate storage spaces with one evaporator and two fans, thereby reducing production cost and increasing the volume in the refrigerator.

An object of the present disclosure provides a refrigerator capable of increasing the heat transfer area of the evaporator by forming a flow path toward a first storage chamber or a second storage chamber on a space of a grille fan assembly that partitions a space in which the first storage chamber and an evaporator are provided.

Technical Solution

In a refrigerator according to an embodiment of the present disclosure, a first flow path part configured to supply the cold air forcedly flowing by a first fan to a first storage chamber and a second flow path part configured to supply the cold air forcedly flowing by a second fan are provided in a space between a heat insulating member and a shroud constituting a grille fan assembly that partitions the first storage chamber into a storage space and an evaporator accommodation space.

A refrigerator according to an embodiment of the present disclosure includes a cabinet, a first storage chamber configured to be provided at one side of the cabinet to store food, a second storage chamber configured to be provided on the other side of the cabinet, and a grille fan assembly configured to partition the inner portion of the first storage chamber into a space in which an evaporator is provided, in which the grille fan assembly includes a grille panel forming a front surface of the grille fan assembly and forming a portion of an inner surface of the first storage chamber, a shroud forming a rear surface of the grille fan assembly and on which a first fan and a second fan are mounted; a heat insulating member configured to be provided between the grille panel and the shroud and on which a first flow path part configured to supply the cold air forcibly flowing by the first fan to the first storage chamber and a second flow path part configured to supply the cold air forcibly flowing by the second fan to the second storage chamber are formed on the same surface, and a duct connector configured to be provided at a position corresponding to the second fan in a space between the shroud and the heat insulating member and connected to the second flow path part to form an independent flow path.

The first flow path part may be formed to branch on both sides as it goes downward, and the second flow path part may be formed between the branched first flow path parts.

A fan suction port into which cold air circulating in the first storage chamber is suctioned may be formed by opening a portion of a lower end portion of the grille panel.

The heat insulating member may include a pair of flow path forming parts formed to be spaced apart from each other at a predetermined interval on both sides with respect to the center of the heat insulating member, and the flow path forming part may protrude from the rear surface of the heat insulating member to partition the first flow path part and the second flow path part.

The second flow path part may be formed to extend to a lower end in the center of the heat insulating member, the duct connector may be provided at the upper end of the second flow path part, and the cold air flowing into the duct connector may be guided to the lower side of the heat insulating member to supply the cold air to the second storage chamber.

The flow path forming part may be formed to be closer to both ends of the heat insulating member toward the lower side, and a water take-out guide part configured to discharge water from the inside of the grille fan assembly may be formed between the flow path forming part and both ends of the heat insulating member.

The duct connector may be spaced apart from the heat insulating member in the front and rear direction and is mounted on the shroud, and cold air forcedly flowing by the first fan may flow into a space between the duct connector and the heat insulating member.

The duct connector may include a cold air inflow part provided at a position corresponding to the second fan and into which cold air forcedly flowing by the second fan flows, and a guide part extending downward from the lower end of the cold air inflow part to guide the flow of cold air flowing by the second fan.

The duct connector may include a negative pressure compensation hole formed to pass through the cold air inflow part so that a portion of air discharged when the first fan is driven is prevented from flowing into the cold air inflow part and flowing backward the air in the second storage chamber.

The cold air inflow part may include a recessed part which is recessed from one side in the second fan direction so that the cold air forcedly flowing from the first fan flows across the duct connector, in which the negative pressure compensation hole may be formed on the recessed part.

The duct connector may further include a guide rib provided below the negative pressure compensation hole and protruding in the shroud direction along the inner surface of the duct connector to guide cold air flowing into the negative pressure compensation hole to a lower end portion of the duct connector.

The lower end of the duct connector may be opened, and the lower end of the duct connector may be located above the lower end of the heat insulating member.

The duct connector may further include a border part extending outward along the opened circumference, and a connector boss part through which a connector coupling part protruded from the shroud passes may be provided in the border part.

The border part may further include a connector fixing part protruding forward and into which a coupling member is inserted.

The shroud may have a first fan mounting part and a second fan mounting part on which the first fan and the second fan are mounted respectively, and an evaporator accommodation part, which is recessed forward to form a space in which the evaporator is accommodated, may be provided on the rear surface of the shroud.

The evaporator accommodation part may have the same distance to both ends in the left and right direction with respect to the center of the shroud.

The shroud may include a water take-out rib formed to support an inner surface of the water take-out guide part at a position corresponding to the water take-out guide part.

The water take-out rib may include a first rib formed in a shape corresponding to one end of the flow path forming part, and a second rib spaced apart from the first rib and formed in a shape corresponding to one end of the water take-out guide part, and in which the shroud may include a shroud water take-out hole formed through the shroud between the lower ends of the first rib and the second rib.

A pair of support parts configured to support an inner surface of the second flow path part may be provided at the center of the front lower part of the shroud.

A central water take-out rib protruding forward from the front surface of the shroud to guide the discharge of water generated in the second flow path part may be provided between the pair of support parts, and a central water take-out hole passing through the shroud may be provided in the lower end of the central water take-out rib.

Advantageous Effect

The refrigerator according to the embodiment of the present disclosure can expect the following effects.

A refrigerator according to an embodiment of the present disclosure includes both first flow path part for guiding cold air into a first storage chamber and a second flow path part for guiding cold air into a second storage chamber in a space between a heat insulating member and a shroud constituting a grille fan assembly. Accordingly, only by providing a heat insulating member between the grille panels, the grille fan assembly can be insulated, thereby simplifying the configuration.

In addition, a duct connector is provided in a space between the shroud and the heat insulating member, and the duct connector flows cold air discharged by the second fan into the second flow path and supplies the cold air to the second storage chamber. In other words, since a separate space in which the duct connector is provided is not required, it is possible to maximize the space for accommodating the evaporator provided on the rear surface of the shroud. Accordingly, there is an advantage that the heat transfer area of the evaporator can increase.

In addition, the duct connector is mounted on the shroud so as to be spaced apart from the heat insulating member by a predetermined interval. In addition, one side of the duct connector is cut to form a recessed part recessed inward. Accordingly, there is an advantage that the cold air forcibly flowing by the switching chamber fan is evenly distributed on both left and right sides of the heat insulating member across the duct connector by the recessed part, without the flow path being obstructed by the duct connector due to the recessed part.

In addition, the duct connector includes a negative pressure compensation hole formed so that, when the first fan is operated, the cold air forcibly flowing by the first fan can flow into the duct connector. By the negative pressure compensation hole, it is possible to prevent a reverse flow of cold air from the second storage chamber in a state where only the first fan is driven.

By preventing the reverse flow of the air in the second storage chamber, it is possible to prevent the temperature of the first storage chamber from rising.

In addition, the grille fan assembly according to an embodiment of the present disclosure forms a water take-out guide part on the heat insulating member so that the defrost water generated during the defrosting operation can be effectively discharged.

DESCRIPTION OF DRAWINGS

FIG. 1 is a front view illustrating a refrigerator according to an embodiment of the present disclosure.

FIG. 2 is a view illustrating a state where a door of the refrigerator is opened.

FIG. 3 is an exploded perspective view illustrating an internal structure of a switching chamber of the refrigerator.

FIG. 4 is a view schematically illustrating an air flow in the refrigerator.

FIG. 5 is an exploded perspective view illustrating the grille fan assembly according to an embodiment of the present disclosure viewed from the front.

FIG. 6 is an exploded perspective view illustrating the grille fan assembly viewed from the rear.

FIG. 7 is a view illustrating a state where the grille fan assembly is assembled viewed from the rear.

FIG. 8 is a perspective view illustrating a duct connector according to an embodiment of the present disclosure viewed from the front.

FIG. 9 is a rear view illustrating the duct connector viewed from the rear.

FIG. 10 is a cross-sectional view taken along line X-X' of FIG. 7.

FIG. 11 is a perspective view illustrating a shroud according to an embodiment of the present disclosure viewed from the front.

FIG. 12 is a cross-sectional view taken along line XII-XII' of FIG. 7.

FIG. 13 is a longitudinal cross-sectional view illustrating the flow of cold air toward the switching chamber.

FIG. 14 is a longitudinal cross-sectional view illustrating the flow of cold air toward the refrigerating chamber.

BEST MODE

Hereinafter, specific embodiments of the present disclosure will be described in detail with reference to the drawings. However, the present disclosure cannot be said to be limited to the embodiments in which the spirit of the present disclosure is presented, and other disclosures that are degenerate by addition, changes, deletions, or the like of other elements or other embodiments included within the scope of the present disclosure can be easily suggested.

Although the embodiment of the present disclosure has been described as an example of a top-mount type refrigerator in which the freezing chamber is provided above the refrigerating chamber for convenience of explanation and understanding, it should be noted that the present disclosure is applicable to all types of refrigerators provided with one evaporator and two fans.

FIG. 1 is a front view illustrating a refrigerator according to an embodiment of the present disclosure, and FIG. 2 is a view illustrating a state where a door of the refrigerator is opened.

As illustrated in the drawing, a refrigerator 1 according to an embodiment of the present disclosure may include a cabinet 10 forming a storage space and a door 20 for opening and closing the storage space of the cabinet 10.

The cabinet 10 is vertically partitioned by a barrier 13 and may include a first storage chamber 11 disposed on the upper portion and a second storage chamber 12 disposed on the lower portion. The first storage chamber is usually used as a freezing chamber, and when necessary, the temperature of the freezing chamber is changed to a temperature of the refrigerating chamber by a user's manipulation, so that the freezing chamber can be used as a refrigerating chamber. Accordingly, the first storage chamber 11 may be referred to as a switching chamber or a freezing chamber.

Hereinafter, the first storage chamber 11 will be referred to as a switching chamber and the second storage chamber 12 will be referred to as a refrigerating chamber.

An evaporator 15 may be provided at the inner rear side of the switching chamber 11, and the cold air generated by the evaporator 15 is supplied to the switching chamber 11 and the refrigerating chamber 12 so that the switching chamber 11 and the refrigerating chamber 12 can be cooled.

A plurality of accommodation members including a shelf 111 and a basket may be provided inside the switching chamber 11, and an ice maker for making ice may be separately provided.

The rear wall surface of the switching chamber 11 may be formed by the grille fan assembly 40. The grille fan assembly 40 may partition a space inside the switching chamber 11 back and forth. In other words, the grille fan assembly 40 may partition the inside of the switching chamber 11 so that a space in which food is accommodated is formed in the front and a space in which the evaporator 15 is accommodated is formed in the rear. The grille fan assembly 40 may have a plurality of discharge ports for discharging cold air into the switching chamber 11.

A multi-duct 121 may be provided on the rear wall surface of the refrigerating chamber 12. The multi-duct 121 communicates with a space inside the switching chamber 11 in which the evaporator 15 is provided and supplies cold air into the refrigerating chamber 12. The multi-duct 121 may be formed to be long vertically, and a plurality of discharge ports 121*a* of the refrigerating chamber are formed in the multi-duct 121 to supply cold air into the refrigerating chamber 12.

A machine chamber 14 in which a plurality of electrical components including a compressor 141 and a condenser are provided may be provided at the lower rear end of the cabinet 10.

The door 20 may include a switching chamber door 21 and a refrigerating chamber door 22 that independently shield the switching chamber 11 and the refrigerating chamber 12, respectively. The switching chamber door 21 and the refrigerating chamber door 22 are rotatably mounted on the cabinet 10, and the switching chamber 11 and the refrigerating chamber 12 can be opened and closed by rotation.

A first handle 221 recessed downward so as to be gripped by a user may be provided on the upper surface of the refrigerator chamber door 22, and a second handle 211 recessed upwardly may be provided on the lower surface of the switching chamber door 21.

The refrigerator 1 may include a display part 30 that displays temperature information and operation state information of the freezing chamber 14 and the refrigerating chamber 13 of the refrigerator. The display part 30 may be disposed on the refrigerator door 20 disposed at eye level of a user having an average height among the plurality of refrigerator doors 20, that is, at a height at which the user can easily identify or operate the display part 30.

FIG. 3 is an exploded perspective view illustrating an internal structure of a switching chamber of the refrigerator and FIG. 4 is a view schematically illustrating an air flow in the refrigerator.

As illustrated in the drawing, a grille fan assembly 40 is provided on the rear side surface of the switching chamber 11. The grille fan assembly 40 forms a space in which the evaporator 15 can be accommodated in the rear of the switching chamber 11, and the cold air generated by the evaporator 15 is supplied into the switching chamber 11 and the refrigerating chamber 12 to form a flow path.

The evaporator 15 is seated in a space behind the grille fan assembly 40, and a defrost heater 16 may be provided in the evaporator 15. The defrost heater 16 is configured to be turned on and off at a cycle set to remove ice frozen on the evaporator 15 and the cold air flow path to perform a defrosting operation. In addition, when the temperature of the switching chamber 11 is converted to the temperature of the refrigerating chamber 12, the defrost heater may be operated to rapidly increase the temperature of the switching chamber 11.

The refrigerating chamber supply duct 114 is for supplying cold air from the evaporator 15 to the refrigerating chamber 12 and is opened to guide the cold air from the duct connector 80 provided in the grille fan assembly 40. In addition, the refrigerating chamber supply duct 114 is connected to the multi-duct 121 to evenly supply cold air to the refrigerating chamber 12.

The grille fan assembly 40 is provided to shield the evaporator 15 from the front and cold air of the evaporator 15 may be supplied to the refrigerating chamber 12 and the switching chamber 11, respectively by the first fan and the second fan 61 and 62 and the cold air flow path formed in the grille fan assembly 40.

FIG. 5 is an exploded perspective view illustrating the grille fan assembly according to an embodiment of the present disclosure viewed from the front, FIG. 6 is an exploded perspective view illustrating the grille fan assembly viewed from the rear, and FIG. 7 is a view illustrating a state where the grille fan assembly is assembled viewed from the rear.

As illustrated in the drawing, the grille fan assembly 40 may include a grille panel 50, a heat insulating member 70, a duct connector 80, and a shroud 90.

In detail, the grille panel 50, which forms the rear surface of the switching chamber 11, may be formed in a rectangular plate shape and may be injection-molded from a plastic material. In addition, the grille panel 50 may have a bent pan border 51 configured to be coupled to the shroud 90. The pan border 51 may be formed to extend rearwardly along the circumference of the grille panel 50 from the rear surface of the grille panel 50.

A coupling hook 511 fastened to the coupling part 91 formed around the shroud 90 may be formed on the fan border 51. In other words, by the coupling of the shroud 90 and the grille panel 50, the heat insulating member 70 and the duct connector 80 provided in the grille fan assembly 40 can be maintained in a coupled state.

In addition, a coupling member insertion hole 52 into which a coupling member is inserted is formed in the center of the grille panel 50. The coupling member insertion hole 52 may be provided in a pair on both left and right sides. In addition, an insertion boss 521 formed to protrude rearward and to pass through the coupling member insertion hole 52 may be formed on the rear surface of the coupling member insertion hole 52.

The insertion boss 521 is formed to pass through the coupling member, and the coupling member is formed to pass through the heat insulating member 70 and the shroud 90, so that the coupling member may be configured to pass through the insertion boss 521 and be fixed to the shroud 90.

In addition, the coupling member may be inserted through the coupling member insertion hole 52 and may be configured to be fixed to the shroud 90 through the insertion boss 521.

A sensor mounting part 53 may be formed in the center of the upper end of the grille panel 50. The sensor mounting part 53 may have at least one opening formed in a predetermined size on the front surface of the grille panel 50. A switching chamber sensor 531 is provided inside the sensor mounting part 53 to measure the temperature inside the switching chamber 11.

In addition, upper fan discharge ports 54 may be formed on both sides with respect to the sensor mounting part 53. The upper fan discharge port 54 may be formed to be long in the horizontal direction from the upper end of the rear surface of the switching chamber 11. In addition, a grille may be formed in the upper fan discharge port 54, and cold air may be uniformly supplied to the switching chamber 11.

A lower fan discharge port 55 is formed in the central portion of the grille panel 50. The lower fan discharge port 55 may be formed below the coupling member insertion hole 52. The lower fan discharge port 55 may be opened to supply cold air flowing by the switching chamber fan 61 into the switching chamber 11. The lower fan discharge port 55 may be disposed in an asymmetric shape on both sides with respect to the coupling member insertion hole 52. For example, in the lower fan discharge port 55, a plurality of lower fan discharge ports 55 are formed at positions corresponding to the mounting positions of the ice maker 112 disposed inside the switching chamber 11, so that it is possible to smoothly supply cold air to the ice maker 112. For example, a plurality of lower fan discharge ports 55 are spaced apart from each other in the vertical direction on a side of the left and right sides, and a single lower fan discharge port 55 may be formed on the other side of the left and right sides.

Meanwhile, since the cold air discharged to the switching chamber 11 is directed downward, the area of the upper fan discharge port 54 may be larger than the area of the lower fan discharge port 55 in order to resolve an imbalance in the distribution of cold air inside the switching chamber 11.

A fan suction port 56 may be formed at the lower end portion of the grille panel 50. The fan suction port is formed to guide the cold air circulating in the switching chamber 11 to the space in which the evaporator 15 is accommodated.

The lower end portion of the grille panel 50 may be bent multiple times. In detail, at the lower end portion of the grille panel 50, a first stepped part 571 bent and extended toward the front of the switching chamber 11, and a second stepped part 572 extending downward from one end of the first stepped part 571 may be formed. In addition, a portion of the front surface of the second stepped part 572 may be opened to form the fan suction port 56. A plurality of the fan suction port 56 may be formed to be long in the horizontal direction from both sides with respect to the center of the second stepped part 572.

A fixing part 58 protruding rearwardly to fix the heat insulating member 70 may be formed on the rear surface of the second stepped part 572. The fixing part 58 may include a first fixing part 581 formed by bending at one end of the fan suction port 56 and a second fixing part 582 extending from the rear surface of the second stepped part 572 in a direction crossing the first fixing part 581. A region in which the heat insulating member protrusion 71 formed on the heat insulating member 70 is fixed to the grille panel 50 may be formed by the first fixing part 581 and the second fixing part 582.

The first fixing part 581 and the second fixing part 582 may fix the heat insulating member protrusion 71 formed on the heat insulating member 70 at both ends and the upper end, respectively.

Meanwhile, a heat insulating member 70 is provided at the rear of the grille panel 50. The heat insulating member 70 prevents the cold air of the evaporator 15 from being radiated and conducted to the switching chamber 11, and it is possible to form a flow path that allows, at the same time, the cold air to flow into the switching chamber 11 and the refrigerating chamber 12 independently.

The heat insulating member 70 may be made of a material that is easy to mold and has excellent insulation performance. For example, the heat insulating member 70 may be formed of an expanded polystyrene (EPS) material.

The heat insulating member 70 is provided behind the grille panel 50 and may be accommodated in the grille panel 50 and the shroud 90. A circumference of the heat insulating member 70 may be formed to be in close contact with the inner surfaces of the grille panel 50 and the shroud 90. In addition, the heat insulating member 70 may be fixedly mounted inside the grille fan assembly 40 by coupling the grille panel 50 and the shroud 90 and fastening the coupling member.

The heat insulating member protrusion 71 may be formed on the front surface of the heat insulating member 70, that is, the front surface formed to be in contact with the grille panel 50. The heat insulating member protrusion 71 protrudes forward from the front surface of the heat insulating member 70, and when the heat insulating member 70 is coupled to the grille panel 50, the heat insulating member protrusion can be inserted into the stepped parts 571 and 572.

The heat insulating member protrusion 71 may include a first protrusion 711 formed at the center of the lower end of the heat insulating member and a pair of second protrusions 712 formed on both sides of the lower end of the heat insulating member. In addition, an opened heat insulating member suction port 713 may be formed so that the cold air suctioned from the fan suction port 56 can flow in the space between the first protrusion 711 and the second protrusion 712.

The upper end of the heat insulating member 70 may be located below the upper end of the grille panel 50.

In the heat insulating member 70, a heat insulating member discharge port 72 may be formed at a position corresponding to the lower fan discharge port 55. The heat insulating member discharge port 72 may be opened to supply cold air flowing by the switching chamber fan 61 into the switching chamber 11.

In addition, in the heat insulating member 70, the heat insulating member insertion hole 73 may be formed at a position corresponding to the coupling member insertion hole 52. The heat insulating member insertion hole 73 allows the insertion boss 521 to pass therethrough, so that the heat insulating member 70 may be fixedly mounted in a space between the grille panel 50 and the shroud 90.

The rear surface of the heat insulating member 70 may be partitioned into an upper region 74 in which cold air flows by the first fan 61 and the second fan 62, and a lower region 75 below the upper region 74. The lower region 75 may be a region corresponding to the position of the evaporator 15. Here, the first fan 61 may be referred to as a "switching chamber fan" in that the first fan 61 forcibly flows cold air into the switching chamber 11, and the second fan 62 may be referred to as a "refrigerating chamber fan" in that the cold air flows into the refrigerating chamber 12. Hereinafter, the first fan 61 will be referred to as a switching chamber fan and the second fan will be referred to as a refrigerating chamber fan.

In detail, an evaporator accommodation part 92 which is recessed is formed on the lower rear surface of the shroud 90, and the evaporator 15 may be located in an inner region of the evaporator accommodation part 92. In addition, the heat insulating member 70 may be formed to correspond to the evaporator accommodation part 92, and the lower region 75 may be recessed inward than the upper region 74.

In the heat insulating member 70, heat insulating member stepped parts 741 may be formed on both sides of the upper region 74. The heat insulating member stepped part 741 may provide a space in which the fan mounting parts 951 and 952 and the heat insulating member 70 are spaced apart from each other by a predetermined distance while being coupled to the shroud 90. Accordingly, it is possible to provide a space for the cold air flowing by the switching chamber fan 61 and the refrigerating chamber fan 62 to flow in the space between the shroud 90 and the heat insulating member 70.

Meanwhile, a first flow path part 76 and a second flow path part 77 may be formed in the upper region 74 and the lower region 75. The first flow path part 76 may also be referred to as a "switching chamber flow path part" in that the cold air forcibly flowing by the switching chamber fan 61 flows into the switching chamber 11. In addition, the second flow path part 77 may be referred to as a "refrigerating chamber flow path part" in that the cold air forcedly flowing by the refrigerating chamber fan 62 flows into the refrigerating chamber 12. Hereinafter, the first flow path part 76 will be referred to as a switching chamber flow path part, and the second flow path part 77 will be referred to as a refrigerating chamber flow path part.

In detail, a switching chamber flow path part 76 may be formed on the rear surface of the heat insulating member 70. The switching chamber flow path part 76 is recessed from the rear surface of the heat insulating member 70, so that the cold air generated by the evaporator 15 passes through the switching chamber fan mounting part 951, and the cold air flowing into the space between the shroud 90 and the heat insulating members 70 passes through the upper fan discharge port 54 and the lower fan discharge port 55 formed in the grille panel 50 to flow into the switching chamber 11.

The switching chamber flow path part 76 may be formed by connecting the upper region 74 and the lower region 75. In other words, the switching chamber flow path part 76 may be connected from the upper end of the heat insulating member 70 and extend downward.

The switching chamber flow path part 76 may be formed to branch toward both sides as it goes downward. In addition, the refrigerating chamber flow path part 77 may be formed between the branched switching chamber flow path parts 76.

In other words, the switching chamber flow path part 76 and the refrigerating chamber flow path part 77 may be formed together on the rear surface of the heat insulating member 70. The refrigerating chamber flow path part 77 is coupled to the duct connector 80 to form an independent flow path through which cold air flows into the refrigerating chamber so that the cold air generated in the evaporator 15 may be guided to the refrigerating chamber 12.

The refrigerating chamber flow path part 77 may be formed by a flow path forming part 78 protruding rearward from the switching chamber flow path part 76 in the heat insulating member 70. The flow path forming part 78 may be formed as a pair in both left and right directions with respect to the center of the heat insulating member 70. The pair of flow path forming parts 78 may be spaced apart from each other at a set interval based on the center of the heat insulating member 70 to form the refrigerating chamber flow path part 77.

A duct connector mounting part 771 to which the duct connector 80 is mounted is formed on the upper end of the refrigerating chamber flow path part 77. The duct connector mounting part 771 may be formed above the flow path forming part 78.

The refrigerating chamber flow path part 77 may extend to a lower end portion of the heat insulating member 70. The cold air guided to the inside of the duct connector 80 moves to the lower end portion of the heat insulating member 70 according to the guidance of the refrigerating chamber flow path unit 77, and the cold air at the lower end portion of the refrigerating chamber flow path part 77 flows into the refrigerating chamber supply duct 114.

Meanwhile, the flow path forming parts 78 may be formed so that the width between the flow path forming parts is widen as it goes downward. In addition, the flow path forming part 78 may be formed to be closer to both ends of the heat insulating member 70 as it goes downward.

In addition, a water take-out guide part 79 may be formed at a lower end portion corresponding to the position of the evaporator 15 on the rear surface of the heat insulating member 70.

The water take-out guide part 79 may be formed by the flow path forming part 78 and both ends of the heat insulating member 70. The water take-out guide part 79 is formed so that water due to defrost water or dew condensation inside the grille fan assembly 40 can be discharged and may be formed in communication with the switching chamber flow path part 76.

Among both ends of the flow path forming part 78, in both ends of the heat insulating member 70 and an end adjacent thereto, a flow path forming inclined part 781 formed to be closer to the end of the heat insulating member 70 as it goes downward is provided. The inclined part 781 allows the dew or defrost water generated inside the switching chamber flow path part 76 to flow downward along the inclined part 781.

In addition, a water take-out hole 791 is formed at the lower end of the water take-out guide part 79. The water take-out hole 791 may be formed through the heat insulating member 70. The water take-out hole 791 allows water on the switching chamber flow path part 76 to be discharged to the outside of the grille fan assembly 40 through the water take-out guide part 79.

When the heat insulating member 70 is described differently, the flow path forming part 78 is formed to protrude rearward with a predetermined area on the rear surface of the heat insulating member 70 so that the rear surface of the heat insulating member 70 may be partitioned into the switching chamber flow path part 76, the refrigerating chamber flow path part 77, and the water take-out guide part 79.

In addition, in the grille fan assembly 40 of the present disclosure, the switching chamber flow path part 76 and the refrigerating chamber flow path part 77 may be formed together between the heat insulating member 70 and the shroud 90.

Meanwhile, a duct connector 80 is provided behind the heat insulating member 70 to form a refrigerating chamber flow path part 77 together with the heat insulating member 70.

The duct connector 80 is provided between the heat insulating member 70 and the shroud 90. The duct connector 80 is formed of the same material as the heat insulating member 70 and may be mounted on the refrigerating chamber flow path part 77.

FIG. 8 is a perspective view illustrating a duct connector according to an embodiment of the present disclosure viewed from the front, FIG. 9 is a rear view illustrating the duct connector viewed from the rear, and FIG. 10 is a cross-sectional view taken along line X-X' of FIG. 7.

As illustrated in the drawing, the duct connector 80 is formed with one surface opened and may extend downward from the refrigerating chamber fan mounting part 952 of the central portion of the grille fan assembly 40. In addition, the duct connector 80 may be formed in a shape corresponding to a portion of the refrigerating chamber flow path part 77 recessed in the heat insulating member 70 and may be mounted on the shroud 90.

The duct connector 80 may be mounted on the shroud 90 while being spaced apart from the heat insulating member 70 by a predetermined interval. In the space between the heat insulating member 70 and the duct connector 80, by the switching chamber flow path part 76, the cold air forcibly flowing by the switching chamber fan 61, can flow across the duct connector 80 in the horizontal direction. With this structure, the cold air on the switching chamber flow path part 76 can flow to the heat insulating member discharge port 72 formed on both sides of the heat insulating member 70 or the upper fan discharge port 54 formed in the grille panel 50.

The duct connector 80 is located in the refrigerating chamber fan mounting part 952 to guide the cold air flowing by the refrigerating chamber fan 62 in the direction of the refrigerating chamber supply duct 114 to provide the cold air to the refrigerating chamber 12.

The duct connector 80 may include a cold air inflow part 81 positioned in the refrigerating chamber fan mounting part 952 and a guide part 84 that extends from a lower end of the cold air inflow part 81 to guide the flow of the cold air flowing by the refrigerating chamber fan 62. In addition, the duct connector 80 may further include the cold air inflow part 81 and a border part 86 extending outwardly along the circumference of the guide part 84.

One side of the cold air inflow part 81 is opened and is mounted on the shroud 90 at a position corresponding to the refrigerating chamber fan mounting part 952, so that cold air flows to the duct connector 80 by the refrigerating chamber fan 62.

The cold air inflow part 81 may be formed to have a size corresponding to or larger than the size of the refrigerating chamber fan mounting part 952 and may have a circular, rounded shape.

In addition, a negative pressure compensation hole 82 may be formed in the cold air inflow part 81. The negative pressure compensation hole 82 may be formed on the duct connector 80 at a position corresponding to a position where the refrigerator chamber fan 62 is mounted. The negative pressure compensation hole 82 may be formed to penetrate the central portion of the cold air inflow part 81. In other words, the negative pressure compensation hole 82 may be located on an extension line of the rotation center of the refrigerating chamber fan 62.

The negative pressure compensation hole 82 serves to relieve the negative pressure on the cold air inflow part 81 and the refrigerating chamber fan mounting part 952 that become low pressure when the switching chamber fan 61 operates.

The negative pressure compensation hole 82 may be formed on the recessed part 83 that is recessed from one side of the cold air inflow part 81 toward the refrigerating chamber fan 62. The recessed part 83 may be formed by being recessed from one side of the cold air inflow part 81 in the central direction of the cold air inflow part 81.

The recessed part 83 may be formed on one side adjacent to the switching chamber fan 61 among both sides of the duct connector 80. In detail, the recessed part 83 may be cut off from one side of the duct connector 80 and may be recessed in a direction in which the shroud 90 is provided toward the center of the cold air inflow part 81. One side of the duct connector 80 on which the recessed part 83 is formed may extend in the same line as the border part 86. Accordingly, the cold air forcedly flowing by the switching chamber fan 61 flows in the direction in which the recessed part 83 is formed, by the duct connector 80, without being disturbed by the flow path, and the duct connector 80 can flow across in the horizontal direction.

In addition, the cold air forcedly flowing by the switching chamber fan 61 flows upwards of the duct connector 80 along the circumferential surface of the cold air inflow part 81 to be evenly distributed to both sides of the upper fan discharge port 54.

Accordingly, the cold air forcibly flowing by the switching chamber fan 61 can be evenly distributed in the switching chamber 11 only in a case where the cold air flows so as to flow into not only the heat insulating member discharge port 72 disposed on one side adjacent to the switching chamber fan 61, but also the heat insulating member discharge port 72 disposed on one side adjacent to the refrigerating chamber fan 62.

In the present disclosure, a recessed part 83 is formed while providing a gap between the duct connector 80 and the heat insulating member 70, and the cold air forcedly flowing by the switching chamber fan 61 may be guided to flow in the direction of the recessed part 83. In addition, the cold air guided in the direction of the recessed part 83 may cross the duct connector 80 in a horizontal direction and be discharged to the heat insulating member discharge port 72 adjacent to the refrigerator chamber fan 62. In addition, the cold air forcedly flowing by the switching chamber fan 61 may be guided by the circumferential surface of the duct connector 80, pass above the duct connector 80, and flow in the direction of the upper fan the discharge port 54 of the grille panel 50.

In addition, the recessed part 83 is formed such that the depth of the recessed part increases toward the center of the cold air inflow part 81, so that some of the cold air flowing when the switching chamber fan 61 is operated easily flows into the negative pressure compensation hole 82.

With this structure, when the refrigerating chamber fan 62 is stopped and only the switching chamber fan 61 is driven, a negative pressure may be generated at the position of the refrigerating chamber fan 62. In addition, in the embodiment of the present disclosure, since the damper for switching the flow path for supplying cold air to the switching chamber and the refrigerating chamber is not provided, when negative pressure is generated, the cold air in the refrigerating chamber 12 can flow backward through the duct connector 80. At this time, when the cold air from the refrigerating chamber 12 flows backward into the evaporator 15 side, the temperature of the switching chamber 11 rises, and there is a problem that the switching chamber 11 may be overcooled. In addition, when cold air in the refrigerating chamber 12 with high humidity flows into the inside of the refrigerating chamber flow path part 77 and the duct connector 80 and the refrigerating chamber fan 62 side, frost is generated and the flow path is blocked or frozen, thereby causing a problem that the refrigerating chamber fan 62 does not operate normally.

However, in the embodiment of the present disclosure, as illustrated in FIG. 10, some of the cold air flowing when the switching chamber fan 61 is driven flows into a side of the cold air inflow part 81 by the negative pressure compensation hole 82, and thus it is possible to eliminate the negative pressure on the side of the cold air inflow part 81.

With this structure, it is possible to prevent the air inside the refrigerating chamber 12 from flowing backward to the evaporator 15 through the duct connector 80.

The duct connector 80 includes a guide part 84 that is connected to the lower end of the cold air inflow part 81 and extends downward. The guide part 84 is mounted on the refrigerating chamber flow path part 77 of the heat insulating member 70, and the cold air flowing into the cold air inflow part 81 is guides to flow to a side of the refrigerating chamber supply duct 114 via the refrigerating chamber flow path part 77.

In addition, the guide part 84 may guide the cold air forcedly flowing by the switching chamber fan 61 to flow downward along the circumferential surface of the guide part 84. In other words, in the inside of the guide part 84, the cold air forcedly flowing by the refrigerating chamber fan 62 is guided to flow toward the refrigerating chamber supply duct 114, and, in the outside of the guide part 84, the cold air forcedly flowing by the switching chamber fan 61 flows downward by the circumferential surface of the guide part 84 to be guided and to be discharged to the lower fan discharge port 55. In other words, it can be said that the switching chamber flow path part 76 and the refrigerating chamber flow path part 77 are each independently formed by the duct connector 80.

The guide part 84 is formed in a shape corresponding to the refrigerating chamber flow path part 77 and may be positioned to pass through the central portion of the heat insulating member 70. In detail, the refrigerating chamber fan 62 is disposed in one direction from the center line of the shroud 90. The cold air inflow part 81 through which the cold air of the refrigerating chamber fan 62 flows is also located in one direction from the center line of the shroud 90. At this time, the guide part 84 has a structure inclined to one side so that the center line of the guide part 84 can be located on the center line of the shroud 90 in the cold air inflow part 81. In other words, the cold air flowing in the cold air inflow part 81 by the guide part 84 passes through the central portion of the heat insulating member 70 or the shroud 90 and flows toward the refrigerating chamber supply duct 114.

The guide part 84 may have an opened lower end and may be located above the heat insulating member discharge port 72. Alternatively, the guide part 84 may extend to an upper end portion of the refrigerating chamber flow path part 77 formed on the heat insulating member 70. In other words, the guide part 84 may not be formed to have a size corresponding to the entire size of the refrigerating chamber flow path part 77 but may be formed to be smaller.

Although the guide part 84 is formed to have a size corresponding to a portion of the refrigerating chamber flow path part 77, the cold air flowing by the refrigerating chamber fan 62 is moved toward the lower end of the heat insulating member by the duct connector 80, and is guided by the refrigerating chamber flow path part 77 to move the refrigerating chamber supply duct 114.

Meanwhile, a guide rib 85 may be formed inside the duct connector 80, that is, on a surface facing the shroud 90.

The guide rib 85 is formed to protrude from the inner surface of the duct connector 80 in the direction of the shroud 90 and guides so that the cold air flowing into the duct connector 80 through the negative pressure compensation hole 82 can be moved to the lower end portion of the duct connector 80.

In other words, the guide rib 85 is to prevent the cold air inside the refrigerating chamber 12 from flowing backward, at the time of the driving of the switching chamber fan 61, when the cold air discharged to the switching chamber flow path part 76 flows into the duct connector 80 through the negative pressure compensation hole 82, the guide rib 85 guides the flowing cold air to the lower end portion of the duct connector 80 and pushes down the cold air flowing backward from the inside of the refrigerating chamber 12 from above.

The guide rib 85 may extend over the cold air inflow part 81 and the guide part 84. In detail, the guide rib 85 may extend vertically to the lower end portion of the cold air inflow part 81 and the upper end portion of the guide part 84.

The guide rib 85 may be located below the negative pressure compensation hole 82 and located closer to one side of the duct connector 80 on which the recessed part 83 is formed, among both sides of the duct connector 80. In other words, the guide rib 85 is formed so that the cold air flowing through the negative pressure compensation hole 82 flows into the space formed by the guide rib 85 and one side of the duct connector 80.

The cold air guided by the guide rib 85 may be moved to the lower end of the duct connector 80 to push the cold air backflowing from the inside of the refrigerating chamber 12 downward again.

The duct connector 80 may further include a border part 86 extending outwardly along the circumference of the opening. The border part 86 may be formed to extend outwardly (a direction away from the center of the duct connector) along the circumference of the cold air inflow part 81 and the guide part 84. The border part 86 may provide a space in which the duct connector 80 is mounted to the shroud 90.

The guide part 84 may further include a connector inclined part 89 at an upper end portion connected to the cold air inflow part 81. As the guide part 84 is positioned at the central portion of the heat insulating member 70 and extends downward from the lower end of the cold air inflow part 81, the connector inclined part 89 may be inclined in a direction closer to the central portion of the heat insulating member 70. Although the cold air inflow part 81 is provided at a position corresponding to the refrigerating chamber fan 62 by the connector inclined part 89 and is disposed on one side from the central portion of the shroud 90, the guide part 84 may be provided at the center of the refrigerating chamber flow path part 77. Accordingly, the cold air flowing by the refrigerating chamber fan 62 may be smoothly guided to the refrigerating chamber flow path part 77.

A connector boss part 87 through which the connector coupling part 954 formed in the shroud 90 passes may be formed in the border part 86.

The connector boss part 87 may protrude forward from the front surface of the border part 86, and a connector coupling part insertion hole 871 may be formed to allow the connector coupling part 954 to pass therethrough. The duct connector 80 may be mounted to the shroud 90 by the connector boss part 87.

The connector boss part 87 is provided at a position corresponding to the connector coupling part 954 and may be formed on one side of the duct connector 80.

In addition, the border part 86 may include a connector fixing part 88 that protrudes forward and into which the coupling member is inserted. The connector fixing part 88 may have a coupling member insertion hole 881 through which the coupling member passes so that the shroud 90 and the duct connector 80 can be fixedly coupled. The connector fixing part 88 may be inserted into an insertion hole 953 formed on one side of the switching chamber fan mounting part 951 to firmly fix the duct connector 80 to the shroud 90.

The lower end of the duct connector 80 is formed to be opened, so that when the grille fan assembly 40 is mounted, the lower end of the duct connector 80 may be connected to the lower end of the refrigerating chamber flow path part 77. Accordingly, the lower end of the duct connector 80 and the refrigerating chamber flow path part 77 of the heat insulating member 70 may be connected to form a flow path between the refrigerating chamber fan 62 and the refrigerating chamber supply duct 114.

Meanwhile, a shroud 90 forming the rear surface of the grille fan assembly 40 is provided behind the duct connector 80.

FIG. 11 is a perspective view illustrating a shroud according to an embodiment of the present disclosure viewed from the front, and FIG. 12 is a cross-sectional view taken along line XII-XII' of FIG. 7.

The shroud 90 may be coupled to the grille panel 50 so that the heat insulating member 70 and the duct connector 80 may be accommodated inside the shroud 90.

The shroud 90 may be injection-formed from a plastic material and may have a structure in which the duct connector 80 and the heat insulating member 70 are closely fixed to each other.

A switching chamber fan mounting part 951 and a refrigerating chamber fan mounting part 952 may be formed on the shroud 90. The switching chamber fan mounting part 951 and the refrigerating chamber fan mounting part 952 may be disposed on both sides with respect to the center of the shroud 90. Accordingly, the cold air generated by the evaporator 15 may evenly flow toward the switching chamber fan 61 and the refrigerating chamber fan 62.

The switching chamber fan 61 is mounted on the switching chamber fan mounting part 951, and after passing the cold air generated in the evaporator 15 through the heat insulating member discharge port 72, the cold air may be supplied to the switching chamber 11 through the upper fan discharge port 54 and the lower fan discharge port 55.

The refrigerating chamber fan mounting part 952 may be opened at a side of the switching chamber fan mounting part 951. The duct connector 80 may be mounted on the refrigerating chamber fan mounting part 952. Accordingly, when the refrigerating chamber fan 62 is driven, the cold air of the evaporator 15 passes through the refrigerating chamber fan mounting part 952 and is then guided by the duct connector 80 and may be supplied to the refrigerating chamber 12 through the refrigerating chamber supply duct 114 and the multi-duct 121.

In addition, the switching chamber fan mounting part 951 and the refrigerating chamber fan mounting part 952 may be formed to have shapes corresponding to the shapes of the switching chamber fan 61 and the refrigerating chamber fan 62, respectively.

For example, a box fan type fan having a compact structure may be used as the switching chamber fan 61 and the refrigerating chamber fan 62. Accordingly, the thickness of the grille fan assembly 40 may not be increased, and the internal volume of the refrigerator may be maximized. In addition, the fan mounting parts 951 and 952 may be formed in a rectangular hole shape corresponding to the box fan shape.

In addition, the switching chamber and refrigerating chamber fan mounting parts 951 and 952 protrude rearward from the rear surface of the shroud 90 to include seating parts 93 formed along the circumference of the switching chamber fan 61 and the refrigerating chamber fan 62.

In addition, the switching chamber and refrigerating chamber fan mounting parts 951 and 952 may be inclined in a direction opposite to the rotational directions of the switching chamber fan 61 and the refrigerating chamber fan 62. In other words, the bottom surfaces of the switching chamber fan mounting part 951 and the refrigerating chamber fan mounting part 952 may be formed to be inclined at an angle of approximately 20° with respect to the lower end of the grille panel 50. Accordingly, the switching chamber fan 61 and the refrigerating chamber fan 62 may also be mounted in an inclined state, and due to such a structure, the water on the switching chamber fan 61 and the refrigerating chamber fan 62 or the switching chamber fan mounting part 951 and the refrigerating chamber fan mounting part 952 may flow down along the slope without being stagnant.

Although the size and shape of the switching chamber fan 61 and the refrigerating chamber fan 62 are the same, when the switching chamber 11 maintains the freezing temperature, the drive speed of the switching chamber fan 61 can be made faster to satisfy the required cooling power of the switching chamber 11.

An insertion part 94 formed to protrude forward at a position corresponding to the coupling member insertion hole 52 and the heat insulating member insertion hole 73 may be provided on the front surface of the shroud 90. The insertion part 94 may be positioned below the switching chamber and refrigerating chamber fan mounting parts 951 and 952 and may be formed in the center of the shroud 90.

The insertion part 94 may include an insertion hole through which the coupling member passing through the coupling member insertion hole 52 and the heat insulating member insertion hole 73 passes.

Meanwhile, a lower portion of the rear surface of the shroud 90 corresponding to the position of the evaporator 15 includes an evaporator accommodation part 92 which is recessed to provide a space for accommodating the evaporator 15.

The evaporator accommodation part 92 may be formed to be long in the left and right direction below the switching chamber and refrigerating chamber fan mounting parts 951 and 952. For example, the evaporator accommodation part 92 may be formed to have the same distance from the center of the shroud 90 to both ends in the left and right direction. In other words, when viewed in a state where the evaporator 15 is provided on the rear surface of the shroud 90, the central portion of the evaporator 15 may be located at the central portion of the shroud 90. In addition, both ends of the evaporator 15 may be provided at positions corresponding to both ends of the shroud 90.

In other words, the evaporator 15 may be disposed in the remaining region of the rear surface of the shroud 90, except for the region in which the switching chamber and refrigerating chamber fan mounting parts 951 and 952 are formed. In other words, the evaporator 15 having a length corresponding to the width of the shroud 90 in the left and right direction can be disposed. Accordingly, as the entire region under the shroud 90 is provided as a region in which the evaporator 15 can be disposed, there is an advantage that the heat transfer area of the evaporator 15 can be maximized.

Meanwhile, on the front surface of the shroud 90, a water take-out rib 96 protruding forward to facilitate the discharge of dew condensation or defrost water may be provided on the inside and outside of the grille fan assembly 40.

The water take-out rib 96 may be formed to support the inner surface of the water take-out guide part 79 at a position corresponding to the water take-out guide part 79.

In detail, the water take-out rib 96 may be provided in a pair on both sides of the shroud 90 in the region where the evaporator 15 is disposed. The water take-out rib 96 may be formed over the lower end portion of the switching chamber flow path 76 of the heat insulating member 70 and the water take-out guide part 79.

The water take-out rib 96 may include a first rib 961 formed in a shape corresponding to one end of the flow path forming part 78 formed in the heat insulating member 70, a second rib 962 spaced apart from the first rib 961 and formed in a shape corresponding to one end of the water take-out guide part 79, and a third rib 963 connecting the lower ends of the first rib 961 and the second rib 962.

A rib inclined part 964 inclined to be close to both sides of the shroud 90 from the upper end to the lower end is provided on the upper end portion of the first rib 961. The rib inclined part 964 may be formed at a position corresponding to the inclined part 781 of the flow path forming part 78. The rib inclined part 964 allows dew condensation or defrost water to be guided to the shroud water take-out hole 966.

The shroud water take-out hole 966 may be formed between the lower ends of the first rib 961 and the second rib 962. The water take-out hole 966 may be formed through the shroud 90. The water take-out hole 966 has a lower end formed by the third rib 963, and the third rib 963 is formed to be inclined downward from the front to the rear and may discharge dew condensation or defrost water guided to the water take-out hole 966 to the outside of the grille fan assembly 40.

In addition, the water take-out rib 96 may further include a fourth rib 965 extending in a direction from the second rib 962 to the first rib 961. The fourth rib 965 has a structure inclined downward as it extends in the direction of the first rib 961 from the second rib 962. The fourth rib 965 guides the defrost water flowing above the fourth rib 965 in the direction of the second rib 962, so that it can be quickly discharged to the shroud water take-out hole 966.

In addition, a support part 97 for supporting the inner surface of the refrigerating chamber flow path part 77 may be formed in the center of the front lower end portion of the shroud 90. The support part 97 may be formed to protrude from the front surface and the lower surface of the shroud 90 and may be formed as a pair by being spaced apart from each other by a predetermined interval.

In the space between the pair of support parts 97, the lower surface of the shroud 90 penetrates and a discharge part 973 is formed so that the cold air of the refrigerating chamber flow path part 77 is discharged to the outside of the grille fan assembly 40. The cold air that has passed through the duct connector 80 may be guided to the lower end portion of the shroud 90 by the refrigerating chamber flow path part 77, be discharged to the outside of the grille fan assembly 40 by the discharge part 973, and be guided to the refrigerating chamber supply duct 114.

In addition, in the space between the pair of support parts 97, a central water take-out rib 971 protruding forward from the front surface of the shroud 90 and guiding the discharge of dew condensation or defrost water may be provided. The central water take-out rib 971 may be formed to extend from one side of the pair of support parts 97, respectively. The central water take-out rib 971 has an inclined structure so as to approach the center of the space between the support part 97 and the central water take-out rib 971 from the top to the bottom. With this structure, the dew condensation or defrost water generated on the refrigerating chamber flow path part 77 may be guided to the central water take-out hole 972 by the central water take-out rib 971 to be discharged to the outside of the grille fan assembly 40.

Meanwhile, a drain member 116 for collecting water taken out from the water take-out guide part 79 may be further provided below the grille fan assembly 40. The drain member 116 may be connected to the defrost water tube 115 to discharge water collected into the machine chamber 14.

The shroud 90 may be opened at both sides of the discharge part 973 to form a shroud suction port 98 through which the cold air of the switching chamber is suctioned. The cold air circulating in the switching chamber 11 passes through the suction port 98 to move to the space in which the evaporator 15 partitioned by the grille fan assembly 40 is disposed.

The shroud suction port 98 may be formed by the shroud stepped part 981 formed by bending upward from the lower surface of the shroud 90. The shroud stepped part 981 is bent and extended upwards from the lower end of the shroud 90, so that the cool air circulating in the switching chamber 11 may be moved to the space in which the evaporator 15 is disposed from the outside of the grille fan assembly 40 without circulating inside the grille fan assembly 40.

Hereinafter, a state of discharging defrost water from the grille fan assembly will be described in more detail.

Moisture or moisture generated in the refrigerator during operation of the refrigerator may be deposited on the evaporator 15 by the air circulation process to generate frost. The growth of such frost inhibits the flow of air and causes a pressure imbalance, so it is undesirable to drive the defrost heater 16 to perform a defrost operation.

By the defrosting operation in which the defrost heater 16 generates heat, the frost on the switching chamber fan 61, the refrigerating chamber fan 62, and the cold air flow path, including the evaporator 15 may be removed and, at this time, all of the generated defrost water may be discharged to the drain pan of the machine chamber 14.

In this embodiment, it is possible to provide a structure in which the defrost water generated after the defrosting operation can be smoothly discharged.

As illustrated in FIG. 9, the defrosting water formed on the switching chamber fan 61 or the refrigerating chamber fan 62 flows downward along the switching chamber fan 61 or the refrigerating chamber fan 62. At this time, the switching chamber fan 61 or the refrigerating chamber fan 62 may be disposed in an inclined state, and the defrost water may flow downward along the switching chamber fan 61 or the refrigerating chamber fan 62.

Meanwhile, the defrost water generated inside the grille fan assembly 40 may be discharged downward of the grille fan assembly 40 by the water take-out guide part 79.

The defrost water generated inside the switching chamber flow path part 76 flows down to the lower end of the switching chamber flow path part 76, passes through the heat insulating member 70 through the water take-out hole 791, and is discharged along the shroud water take-out hole 966.

The defrost water generated from the duct connector 80 and the refrigerating chamber flow path part 77 may be guided downward along the refrigerating chamber flow path part 77 and be discharged downward of the grille fan assembly 40 through the shroud water take-out hole 966. In addition, the defrost water discharged to the outside of the grille fan assembly 40 may be discharged to the machine chamber 14 through the drain member 116 at the bottom of the switching chamber 11 and the defrost water tube.

Accordingly, all of the defrosting water generated inside and outside the grille fan assembly 40 can be smoothly discharged toward the machine chamber 14.

Hereinafter, the cold air flow state of the refrigerator according to an embodiment of the present disclosure will be described in more detail with reference to the drawings.

FIG. 13 is a longitudinal cross-sectional view illustrating the flow of cold air toward the switching chamber, and FIG. 14 is a longitudinal cross-sectional view illustrating the flow of cold air toward the refrigerating chamber.

As illustrated in the drawing, when the switching chamber fan 61 is operated, the cold air generated by the evaporator 15 is passed through the switching chamber fan 61 from the rear of the grille fan assembly 40 to flow to the switching chamber flow path part 76. Here, the switching chamber flow path part 76 may be formed in a space between the shroud 90 and the heat insulating member 70. The cold air flowing into the front of the shroud 90 through the switching chamber fan 61 flows to the switching chamber flow path part 76 formed in the heat insulating member 70. In this case, the duct connector 80 is provided to be spaced apart from the heat insulating member 70 by a predetermined interval. In addition, a recessed part 83 is formed in the duct connector 80, so that cold air forcedly flowing by the switching chamber fan 61 may cross the duct connector 80 and flow toward the heat insulating member discharge port 72 provided on a side close to the refrigerating chamber fan 62. In addition, the cold air forcedly flowing in the switching chamber fan 61 may be guided upward or downward of the duct connector 80 along the circumferential surface of the duct connector 80, be evenly distributed into the discharge port 54 formed on the grille panel 50 and the lower fan discharge port 55 and be supplied to the inside of the switching chamber 11.

In other words, the cold air flowing along the switching chamber flow path part 76 may be supplied into the switching chamber 11 through the heat insulating member discharge port 72 formed in the heat insulating member 70 and the lower fan discharge port 55 formed in the grille panel 50 and may be supplied to the inside of the switching chamber 11 through the upper end of the heat insulating member 70 and the lower fan discharge port 55.

In addition, the cold air flowing into the switching chamber flow path part 76 can be supplied into the switching chamber 11 through the upper fan discharge port 54 and the lower fan discharge port 55 formed in the grille panel 50.

The cold air flowing into the switching chamber 11 may cool the inside of the switching chamber 11 and then may be recovered to the space in which the evaporator 15 is accommodated through the switching chamber return duct 131 or the fan suction port 56.

The cold air recovered to the space in which the evaporator 15 is accommodated can be cooled again by the evaporator 15. Through this circulation process, the switching chamber 11 may be cooled to a set temperature, and the operation of the switching chamber fan 61 may be controlled by the switching chamber sensor 531.

In addition, the switching chamber 11 may be maintained at a freezing temperature and thus used as a freezing chamber according to a user's selection or may be maintained at the refrigerating temperature and thus used as a space of an expanded refrigerating chamber.

Meanwhile, when the refrigerating chamber fan 62 is operated, the air cooled by the evaporator 15 flows into the duct connector 80 by the refrigerating chamber fan 62. The duct connector 80 is mounted on the refrigerating chamber flow path 77, and the cold air passing through the duct connector 80 moves downward from the central portion of the heat insulating member 70 along the refrigerating chamber flow path part 77.

In other words, the cold air supplied in the direction of the refrigerating chamber 12 is guided downwards from the central portion of the heat insulating member 70 by the refrigerating chamber flow path part 77 independently formed in the space between the shroud 90 and the heat insulating member 70.

The cold air flowing along the refrigerating chamber flow path part 77 may pass through the refrigerating chamber supply duct 114 and be supplied to the multi-duct 121 inside the refrigerating chamber 12. Then, cold air is discharged from the multi-duct 121 into the refrigerating chamber 12.

The cold air supplied into the refrigerating chamber 12 is heat-exchanged inside the refrigerating chamber to cool the refrigerating chamber 12. In addition, the air in the refrigerating chamber 12 heat-exchanged through the refrigerating chamber return duct provided on the upper surface of the refrigerating chamber 12, that is, at the lower end of the barrier 13, can be recovered to the space in which the evaporator 15 is disposed.

The cold air recovered to the space in which the evaporator 15 is accommodated may be cooled again by the evaporator 15. By this circulation process, the refrigerating chamber 12 may be cooled to a set temperature, and the operation of the switching chamber fan 61 may be controlled by the refrigerating chamber temperature sensor.

As such, in the grille fan assembly 40 according to an embodiment of the present disclosure, by the duct connector 80, the switching chamber flow path part 76 and the refrigerating chamber flow path part 77 may be independently formed together in a space between the shroud 90 and the adiabatic member 70. In detail, the refrigerating chamber fan 62 and the switching chamber fan 61 are turned on, and then the cold air flows into the front of the shroud 90. At this time, the cold air flowing by the operation of the switching chamber fan 61 is moved to the switching chamber 11 through the upper fan discharge port 54 and the lower fan discharge port 55 via the switching chamber flow path part 76 formed in the space between the shroud 90 and the heat insulating member 70.

In addition, the duct connector 80 is mounted on the refrigerating chamber fan mounting part 952, and cold air flowing by the operation of the refrigerating chamber fan 62 flows into the duct connector 80, and is discharged to the lower end of the duct connector 80. The cold air discharged to the lower end of the duct connector 80 is guided to the lower end portion of the heat insulating member 70 according to the guidance of the refrigerating chamber flow path part 77 formed in the heat insulating member 70, and flows into the refrigerating chamber supply duct 114 and moves to the refrigerating chamber 12.

Accordingly, as the switching chamber flow path part 76 and the refrigerating chamber flow path part 77 are formed together in the space between the shroud 90 and the heat insulating member 70, separate components such as an insulation sheet for insulating between the switching chamber flow path part 76 and the grille panels 50 are not required, so the simplification of the components is possible.

In addition, since the duct connector 80 is provided in the space between the shroud 90 and the heat insulating member, a separate refrigerating chamber flow path part 77 is not formed on the shroud 90. Accordingly, the shroud 90 can secure a space in which the evaporator 15 is accommodated in the remaining region except for the region where the refrigerating chamber fan mounting part 952 and the switching chamber fan mounting part 951 are formed. Accordingly, there is an advantage that the heat transfer area of the evaporator 15 can be maximized.

INDUSTRIAL APPLICABILITY

The refrigerator according to an embodiment of the present disclosure can cool two separate storage spaces with one evaporator, thereby reducing production cost and increasing the volume in the refrigerator, so industrial applicability is high.

The invention claimed is:

1. A refrigerator comprising:
a cabinet;
a first storage chamber;
a second storage chamber;
an evaporator disposed in the first storage chamber; and
a grille fan assembly that partitions the first storage chamber to thereby define a space accommodating the evaporator;
wherein the grille fan assembly comprises:
a grille panel that defines a front surface of the grille fan assembly and a portion of an inner surface of the first storage chamber,
a first fan and a second fan to blow air toward the grille panel,
a shroud that defines a rear surface of the grille fan assembly and supports the first fan and the second fan,
a heat insulating member disposed between the grille panel and the shroud, the heat insulating member having a surface that defines both of (i) a first flow path to supply air blown by the first fan to the first storage chamber and (ii) a second flow path to supply air blown by the second fan to the second storage chamber, and
a duct connector disposed at a position corresponding to the second fan and disposed between the shroud and the heat insulating member, the duct connector defining a third flow path connected to the second flow path,
wherein the first fan and the second fan are disposed on the same surface of the heat insulating member,
wherein the first flow path extends downward and is branched to a plurality of first flow paths, and
wherein the duct connector is disposed between the plurality of first flow paths.

2. The refrigerator of claim 1, wherein the second flow path is defined between the plurality of first flow paths.

3. The refrigerator of claim 1, wherein the grille panel defines a fan suction port at a lower end portion thereof, the fan suction port to receive air from the first storage chamber.

4. The refrigerator of claim 1, wherein the heat insulating member comprises a pair of flow path forming protrusions that are spaced apart from each other and disposed at first and second sides with respect to a center of the heat insulating member, respectively, and
wherein the pair of flow path forming protrusions protrude from a rear surface of the heat insulating member and partition the first flow path and the second flow path from each other.

5. The refrigerator of claim 4, wherein the second flow path extends to a lower end of the heat insulating member,
wherein the duct connector is disposed at an upper end of the second flow path, and
wherein the second flow path guides air from the duct connector to the lower end of the heat insulating member to thereby supply the air blown by the second fan to the second storage chamber.

6. The refrigerator of claim 5, wherein the duct connector is coupled to the shroud and spaced apart from the heat insulating member, the duct connector to guide the air blown by the first fan into a space defined between the duct connector and the heat insulating member.

7. The refrigerator of claim 4, wherein the pair of flow path forming protrusions comprise:
a first flow path forming protrusion that extends toward a first lower end of the heat insulating member and is disposed at the first side with respect to the center of the heat insulating member; and
a second flow path forming protrusion that extends toward a second lower end of the heat insulating member and is disposed at the second side with respect to the center of the heat insulating member.

8. The refrigerator of claim 5, wherein the duct connector comprises:
a cold air inflow inlet that is disposed at a position corresponding to the second fan to receive the air blown by the second fan; and
an air guide that extends downward from a lower end of the cold air inflow inlet to guide the air blown by the second fan.

9. The refrigerator of claim 1, wherein the shroud defines:
a first fan mounting space that receives the first fan; and
a second fan mounting space that receives the second fan.

10. The refrigerator of claim 9, comprising an evaporator accommodation space that is recessed forward from a rear surface of the shroud and accommodates the evaporator, wherein the evaporator accommodation space is defined at a center of the shroud such that a distance from the center of the shroud to a left end of the evaporator accommodation space is equal to a distance from the center of the shroud to a right end of the evaporator accommodation space.

11. A refrigerator comprising:

a cabinet;

a first storage chamber;

a second storage chamber;

an evaporator disposed in the first storage chamber, and a grille fan assembly that partitions the first storage chamber to define a space accommodating the evaporator and a storage space;

wherein the grille fan assembly comprises:

a grille panel that defines a rear surface of the first storage chamber, a shroud that defines a rear surface of the grille fan assembly, a first fan and a second fan to blow air in a direction toward the grille panel, and an air flow forming assembly located between the grille panel and the shroud, the air flow forming assembly having a first flow path to supply the air blown by the first fan toward the grille panel and to the storage space of the first storage chamber, and a second flow path to supply the air blown by the second fan to the second storage chamber, a duct connector to guide the air blown by the second fan, the duct connector located between the second fan and the second flow path, wherein the first fan and the second fan are disposed on a same side with respect to the air flow forming assembly, wherein the first flow path extends downward and is branched to a plurality of first flow paths, and wherein the duct connector is disposed between the plurality of first flow paths.

12. The refrigerator of claim 11, wherein the shroud includes a first fan mounting space to mount the first fan and a second fan mounting space to mount the second fan.

13. The refrigerator of claim 12, wherein the first fan and the second fan are mounted on a same surface at the shroud.

14. The refrigerator of claim 11, wherein the air flow forming assembly includes the first flow path branching into a plurality of flow paths, the plurality of flowing paths to flow the air in the grille fan assembly, wherein the air flows out through the grille panel, and the second flow path that flows the air between the plurality of flow paths, wherein the air flows toward the second storage chamber.

15. The refrigerator of claim 14, wherein the second flow path is formed in a center portion of the grille fan assembly, and a portion of the plurality of the flow paths are formed at respective side portions of the grille fan assembly.

16. The refrigerator of claim 11, comprising a heat insulating member located between the grille panel and the shroud, and the air flow forming assembly is located at the heat insulating member.

17. The refrigerator of claim, 16, wherein the air flow forming assembly includes a pair of flow path forming protrusions that are spaced apart from each other and located at first and second sides with respect to a center portion of the heat insulating member, respectively, and wherein the pair of flow path forming protrusions protrude from a rear surface of the heat insulating member and partition the first flow path and the second flow path from each other.

18. The refrigerator of claim 17, wherein the duct connector is coupled to the shroud, and contoured to guide the air blown by the first fan into a space defined between the duct connector and the heat insulating member.

19. The refrigerator of claim 17, wherein the duct connector comprises:

a cold air inflow inlet located to receive the air blown by the second fan and an air guide that extends from the cold air inflow inlet to guide the air blown by the second fan.

* * * * *